US008863860B2

(12) United States Patent
Chen et al.

(10) Patent No.: US 8,863,860 B2
(45) Date of Patent: Oct. 21, 2014

(54) SYSTEM AND METHOD OF IMPROVED DEPTH OF CUT CONTROL OF DRILLING TOOLS

(75) Inventors: Shilin Chen, Montgomery, TX (US); James R. Ashby, Conroe, TX (US); Robert W. Arfele, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 455 days.

(21) Appl. No.: 13/293,788

(22) Filed: Nov. 10, 2011

(65) Prior Publication Data

US 2012/0111630 A1 May 10, 2012

Related U.S. Application Data

(60) Provisional application No. 61/412,173, filed on Nov. 10, 2010, provisional application No. 61/416,160, filed on Nov. 22, 2010.

(51) Int. Cl.

| | |
|---|---|
| ***E21B 25/16*** | (2006.01) |
| ***E21B 47/04*** | (2012.01) |
| ***E21B 10/55*** | (2006.01) |
| ***E21B 10/43*** | (2006.01) |

(52) U.S. Cl.

CPC ..... *E21B 10/43* (2013.01); *E21B 47/04* (2013.01); *E21B 10/55* (2013.01)

USPC ..... 175/45; 175/426; 175/327; 175/338

(58) Field of Classification Search

CPC ..... E21B 10/43; E21B 47/04; E21B 10/55; E21B 10/36; E21B 47/02

USPC ..... 175/45, 426, 327, 338, 382

See application file for complete search history.

(56) References Cited

U.S. PATENT DOCUMENTS

| | | | | |
|---|---|---|---|---|
| 2006/0278436 | A1 * | 12/2006 | Dykstra et al. | 175/57 |
| 2007/0186639 | A1 | 8/2007 | Spross et al. | 73/152.03 |
| 2008/0041629 | A1 | 2/2008 | Aronstam et al. | 175/61 |
| 2009/0090556 | A1 | 4/2009 | Chen | 175/45 |
| 2010/0000800 | A1 | 1/2010 | Chen et al. | 175/430 |

OTHER PUBLICATIONS

International Search Report and Written Opinion; PCT/US2011/060173; pp. 16, Mar. 27, 2012.

International Search Report and Written Opinion; PCT/US2011/060184; pp. 12, Mar. 28, 2012.

International Search Report and Written Opinion; PCT/US2011/060194; pp. 11, Mar. 28, 2012.

* cited by examiner

*Primary Examiner* — Yong-Suk (Philip) Ro

(74) *Attorney, Agent, or Firm* — Baker Botts L.L.P.

(57) ABSTRACT

A method of configuring a depth of cut controller (DOCC) of a drill bit comprises determining a desired minimum depth of cut for a radial swath of the drill bit. The method additionally comprises identifying a cutting edge of a cutting element located on the drill bit. The cutting edge is located within the radial swath and a cutting zone of the cutting element. The method further comprises identifying cutting elements that each include at least a portion located within the radial swath. The method also comprises determining a radial position and an angular position of a depth of cut controller (DOCC) for placement on the bit face based on the cutting edge of the cutting element. The method additionally comprises determining an axial position of the DOCC based on each portion of the cutting elements located within the radial swath.

21 Claims, 14 Drawing Sheets

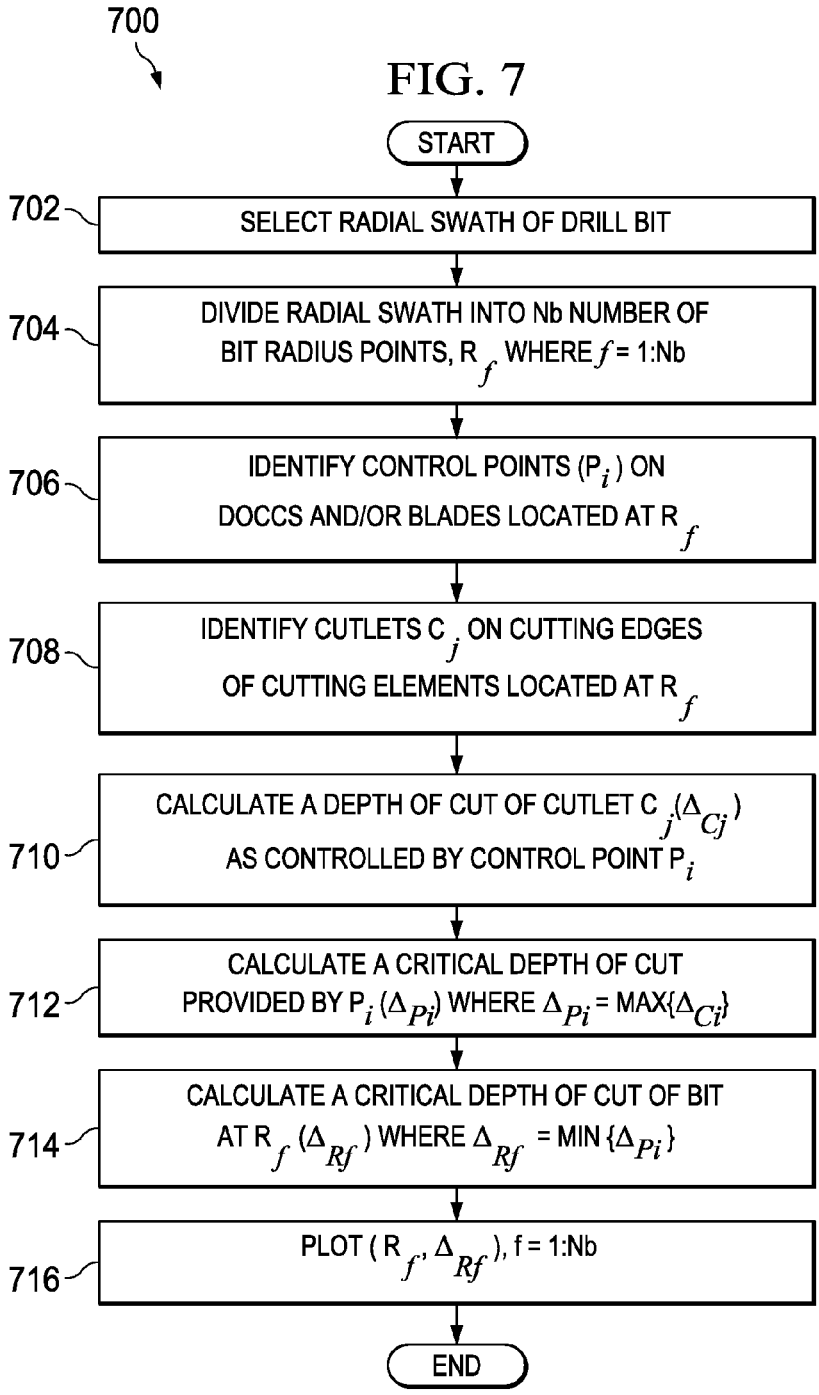
700
FIG. 7
START
702
SELECT RADIAL SWATH OF DRILL BIT
704
DIVIDE RADIAL SWATH INTO Nb NUMBER OF BIT RADIUS POINTS, $R_f$ WHERE $f$ = 1:Nb
706
IDENTIFY CONTROL POINTS ($P_i$) ON DOCCS AND/OR BLADES LOCATED AT $R_f$
708
IDENTIFY CUTLETS $C_j$ ON CUTTING EDGES OF CUTTING ELEMENTS LOCATED AT $R_f$
710
CALCULATE A DEPTH OF CUT OF CUTLET $C_j$($\Delta_{Cj}$) AS CONTROLLED BY CONTROL POINT $P_i$
712
CALCULATE A CRITICAL DEPTH OF CUT PROVIDED BY $P_i$ ($\Delta_{Pi}$) WHERE $\Delta_{Pi}$ = MAX{$\Delta_{Ci}$}
714
CALCULATE A CRITICAL DEPTH OF CUT OF BIT AT $R_f$ ($\Delta_{Rf}$) WHERE $\Delta_{Rf}$ = MIN {$\Delta_{Pi}$}
716
PLOT ( $R_f$, $\Delta_{Rf}$ ), f = 1:Nb
END

SYSTEM AND METHOD OF IMPROVED DEPTH OF CUT CONTROL OF DRILLING TOOLS

RELATED APPLICATION

This application claims the benefit of U.S. Provisional Patent Application Ser. No. 61/412,173 filed Nov. 10, 2010 and U.S. Provisional Patent Application Ser. No. 61/416,160 filed Nov. 22, 2010, which are incorporated herein by reference in their entirety.

TECHNICAL FIELD

The present disclosure relates generally to downhole drilling tools and, more particularly, to improved depth of cut control of drilling tools.

BACKGROUND

Various types of downhole drilling tools including, but not limited to, rotary drill bits, reamers, core bits, and other downhole tools have been used to form wellbores in associated downhole formations. Examples of such rotary drill bits include, but are not limited to, fixed cutter drill bits, drag bits, polycrystalline diamond compact (PDC) drill bits, and matrix drill bits associated with forming oil and gas wells extending through one or more downhole formations. Fixed cutter drill bits such as a PDC bit may include multiple blades that each include multiple cutting elements.

In typical drilling applications, a PDC bit may be used to drill through various levels or types of geological formations with longer bit life than non-PDC bits. Typical formations may generally have a relatively low compressive strength in the upper portions (e.g., lesser drilling depths) of the formation and a relatively high compressive strength in the lower portions (e.g., greater drilling depths) of the formation. Thus, it typically becomes increasingly more difficult to drill at increasingly greater depths. As well, the ideal bit for drilling at any particular depth is typically a function of the compressive strength of the formation at that depth. Accordingly, the ideal bit for drilling typically changes as a function of drilling depth.

A drilling tool may include one or more depth of cut controllers (DOCCs) configured to control the amount that a drilling tool cuts into the side of a geological formation. However, conventional DOCC configurations may not control the depth of cut of the cutting tools to the desired depth of cut and may unevenly control the depth of cut with respect to each other.

SUMMARY

According to some embodiments of the present disclosure, a method of configuring a depth of cut controller (DOCC) of a drill bit comprises determining a desired minimum depth of cut for a radial swath associated with a bit face of the drill bit. The radial swath is associated with an area of the bit face. The method additionally comprises identifying a cutting edge of a cutting element located on the bit face. The cutting edge is located within a cutting zone of the cutting element and located within the radial swath. The method further comprises identifying a plurality of cutting elements located on the bit face that each include at least a portion located within the radial swath. The method also comprises determining a radial position and an angular position of a depth of cut controller (DOCC) for placement on the bit face within the radial swath based on the cutting edge of the cutting element. The method additionally comprises determining an axial position of the DOCC based on the desired minimum depth of cut for the radial swath and each portion of the plurality of cutting elements located within the radial swath.

BRIEF DESCRIPTION OF THE DRAWINGS

For a more complete understanding of the present disclosure and its features and advantages, reference is now made to the following description, taken in conjunction with the accompanying drawings, in which:

FIG. 7 illustrates an example method of determining and generating a critical depth of cut control curve, in accordance with some embodiments of the present disclosure;

DETAILED DESCRIPTION

Embodiments of the present disclosure and its advantages are best understood by referring to FIGS. 1 through 9, where like numbers are used to indicate like and corresponding parts.

Figure 1:
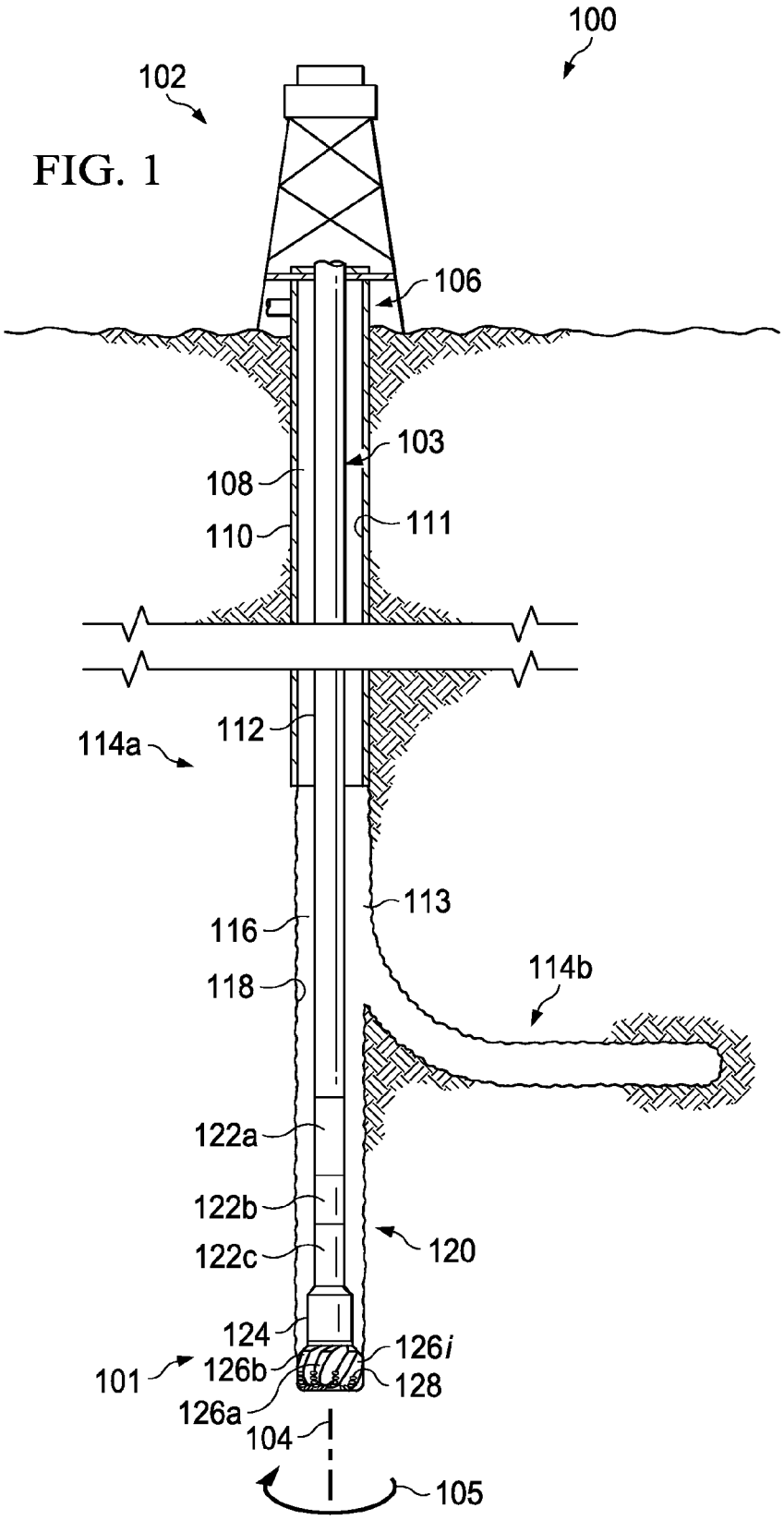
FIG. 1 illustrates an example embodiment of a drilling system in accordance with some embodiments of the present disclosure.

FIG. 1 illustrates an example embodiment of a drilling system 100 configured to drill into one or more geological formations, in accordance with some embodiments of the present disclosure. While drilling into different types of geological formations it may be advantageous to control the amount that a downhole drilling tool cuts into the side of a geological formation in order to reduce wear on the cutting elements of the drilling tool, prevent uneven cutting into the formation, increase control of penetration rate, reduce tool vibration, etc. As disclosed in further detail below, drilling system 100 may include downhole drilling tools (e.g., a drill bit, a reamer, a hole opener, etc.) that may include one or more cutting elements with a depth of cut that may be controlled by one or more depth of cut controllers (DOCC) and/or blade surfaces.

As disclosed in further detail below and according to some embodiments of the present disclosure, a DOCC and/or blade surface may be configured to control the depth of cut of a cutting element (sometimes referred to as a "cutter") according to the location of a cutting zone and cutting edge of the cutting element. Additionally, in the same or alternative embodiments of the present disclosure, a DOCC may be configured according to a plurality of cutting elements that may overlap a radial swath of the drill bit associated with a rotational path of the DOCC, as disclosed in further detail below. In contrast, a DOCC configured according to traditional methods may not be configured according to a plurality of cutting elements that overlap the rotational path of the DOCC, the locations of the cutting zones of the cutting elements or any combination thereof. Accordingly, a DOCC designed according to the present disclosure may provide an improved depth of cut control of the drilling tool compared to DOCCs designed using conventional methods.

Drilling system 100 may include a rotary drill bit ("drill bit") 101. Drill bit 101 may be any of various types of fixed cutter drill bits, including PDC bits, drag bits, matrix drill bits, and/or steel body drill bits operable to form a wellbore 114 extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*i*) that may be disposed outwardly from exterior portions of a rotary bit body 124 of drill bit 101. Rotary bit body 124 may have a generally cylindrical body and blades 126 may be any suitable type of projections extending outwardly from rotary bit body 124. For example, a portion of a blade 126 may be directly or indirectly coupled to an exterior portion of bit body 124, while another portion of the blade 126 is projected away from the exterior portion of bit body 124. Blades 126 formed in accordance with teachings of the present disclosure may have a wide variety of configurations including, but not limited to, substantially arched, helical, spiraling, tapered, converging, diverging, symmetrical, and/or asymmetrical.

In some cases, blades 126 may have substantially arched configurations, generally helical configurations, spiral shaped configurations, or any other configuration satisfactory for use with each downhole drilling tool. One or more blades 126 may have a substantially arched configuration extending from proximate a rotational axis 104 of bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit. In an embodiment of drill bit 101, blades 126 may include primary blades disposed generally symmetrically about the bit rotational axis. For example, one embodiment may include three primary blades oriented approximately 120 degrees relative to each other with respect to bit rotational axis 104 in order to provide stability for drill bit 101. In some embodiments, blades 126 may also include at least one secondary blade disposed between the primary blades. The number and location of secondary blades and primary blades may vary substantially. Blades 126 may be disposed symmetrically or asymmetrically with regard to each other and bit rotational axis 104 where the disposition may be based on the downhole drilling conditions of the drilling environment.

Each of blades 126 may include a first end disposed proximate or toward bit rotational axis 104 and a second end disposed proximate or toward exterior portions of drill bit 101 (i.e., disposed generally away from bit rotational axis 104 and toward uphole portions of drill bit 101). The terms "downhole" and "uphole" may be used in this application to describe the location of various components of drilling system 100 relative to the bottom or end of a wellbore. For example, a first component described as "uphole" from a second component may be further away from the end of the wellbore than the second component. Similarly, a first component described as being "downhole" from a second component may be located closer to the end of the wellbore than the second component.

Each blade may have a leading (or front) surface disposed on one side of the blade in the direction of rotation of drill bit 101 and a trailing (or back) surface disposed on an opposite side of the blade away from the direction of rotation of drill bit 101. Blades 126 may be positioned along bit body 124 such that they have a spiral configuration relative to rotational axis 104. In other embodiments, blades 126 may be positioned along bit body 124 in a generally parallel configuration with respect to each other and bit rotational axis 104.

Blades 126 may have a general arcuate configuration extending radially from rotational axis 104. The arcuate configurations of blades 126 may cooperate with each other to define, in part, a generally cone shaped or recessed portion disposed adjacent to and extending radially outward from the bit rotational axis. Exterior portions of blades 126, cutting elements 128 and DOCCs (not expressly shown) may be described as forming portions of the bit face.

Blades 126 may include one or more cutting elements 128 disposed outwardly from exterior portions of each blade 126. For example, a portion of a cutting element 128 may be directly or indirectly coupled to an exterior portion of a blade 126 while another portion of the cutting element 128 may be projected away from the exterior portion of the blade 126. Cutting elements 128 may be any suitable device configured to cut into a formation, including but not limited to, primary cutting elements, backup cutting elements or any combination thereof. By way of example and not limitation, cutting elements 128 may be various types of cutters, compacts, buttons, inserts, and gage cutters satisfactory for use with a wide variety of drill bits 101.

Cutting elements 128 may include respective substrates with a layer of hard cutting material disposed on one end of each respective substrate. The hard layer of cutting elements 128 may provide a cutting surface that may engage adjacent portions of a downhole formation to form a wellbore 114. The contact of the cutting surface with the formation may form a cutting zone associated with each of cutting elements 128, as described in further detail with respect to FIGS. 4A-4D. The edge of the cutting surface located within the cutting zone may be referred to as the cutting edge of a cutting element 128.

Each substrate of cutting elements 128 may have various configurations and may be formed from tungsten carbide or other materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds.

Blades 126 may also include one or more DOCCs (not expressly shown) configured to control the depth of cut of cutting elements 128. A DOCC may comprise an impact arrestor, a backup cutter and/or an MDR (Modified Diamond Reinforcement). As mentioned above, in the present disclosure, a DOCC may be designed and configured according to the location of a cutting zone associated with the cutting edge of a cutting element. In the same or alternative embodiments, one or more DOCCs may be configured according to a plurality of cutting elements overlapping the rotational paths of the DOCCs. Accordingly, one or more DOCCs of a drill bit may be configured according to the present disclosure to provide an improved depth of cut of cutting elements 128.

Blades 126 may further include one or more gage pads (not expressly shown) disposed on blades 126. A gage pad may be a gage, gage segment, or gage portion disposed on exterior portion of a blade 126. Gage pads may often contact adjacent portions of a wellbore 114 formed by drill bit 101. Exterior portions of blades 126 and/or associated gage pads may be disposed at various angles, either positive, negative, and/or parallel, relative to adjacent portions of a straight wellbore (e.g., wellbore 114*a*). A gage pad may include one or more layers of hardfacing material.

Drilling system 100 may also include a well surface or well site 106. Various types of drilling equipment such as a rotary table, mud pumps and mud tanks (not expressly shown) may be located at a well surface or well site 106. For example, well site 106 may include a drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may include a drill string 103 associated with drill bit 101 that may be used to form a wide variety of wellbores or bore holes such as generally vertical wellbore 114*a* or generally horizontal wellbore 114*b* as shown in FIG. 1. Various directional drilling techniques and associated components of a bottom hole assembly (BHA) 120 of drill string 103 may be used to form horizontal wellbore 114*b*. For example, lateral forces may be applied to drill bit 101 proximate kickoff location 113 to form horizontal wellbore 114*b* extending from generally vertical wellbore 114*a*.

BHA 120 may be formed from a wide variety of components configured to form a wellbore 114. For example, components 122*a*, 122*b* and 122*c* of BHA 120 may include, but are not limited to, drill bits (e.g., drill bit 101) drill collars, rotary steering tools, directional drilling tools, downhole drilling motors, reamers, hole enlargers or stabilizers. The number of components such as drill collars and different types of components 122 included in BHA 120 may depend upon anticipated downhole drilling conditions and the type of wellbore that will be formed by drill string 103 and rotary drill bit 100.

A wellbore 114 may be defined in part by a casing string 110 that may extend from well surface 106 to a selected downhole location. Portions of a wellbore 114, as shown in FIG. 1, that do not include casing string 110 may be described as "open hole." Various types of drilling fluid may be pumped from well surface 106 through drill string 103 to attached drill bit 101. Such drilling fluids may be directed to flow from drill string 103 to respective nozzles (not expressly shown) included in rotary drill bit 100. The drilling fluid may be circulated back to well surface 106 through an annulus 108 defined in part by outside diameter 112 of drill string 103 and inside diameter 118 of wellbore 114*a*. Inside diameter 118 may be referred to as the "sidewall" of wellbore 114*a* Annulus 108 may also be defined by outside diameter 112 of drill string 103 and inside diameter 111 of casing string 110.

The rate of penetration (ROP) of drill bit 101 is often a function of both weight on bit (WOB) and revolutions per minute (RPM). Drill string 103 may apply weight on drill bit 101 and may also rotate drill bit 101 about rotational axis 104 to form a wellbore 114 (e.g., wellbore 114*a* or wellbore 114*b*). For some applications a downhole motor (not expressly shown) may be provided as part of BHA 120 to also rotate drill bit 101. The depth of cut controlled by DOCCs (not expressly shown) and blades 126 may also be based on the ROP and RPM of a particular bit. Accordingly, as described in further detail below, the configuration of the DOCCs to provide an improved depth of cut of cutting elements 128 may be based in part on the desired ROP and RPM of a particular drill bit 101.

Figure 2:
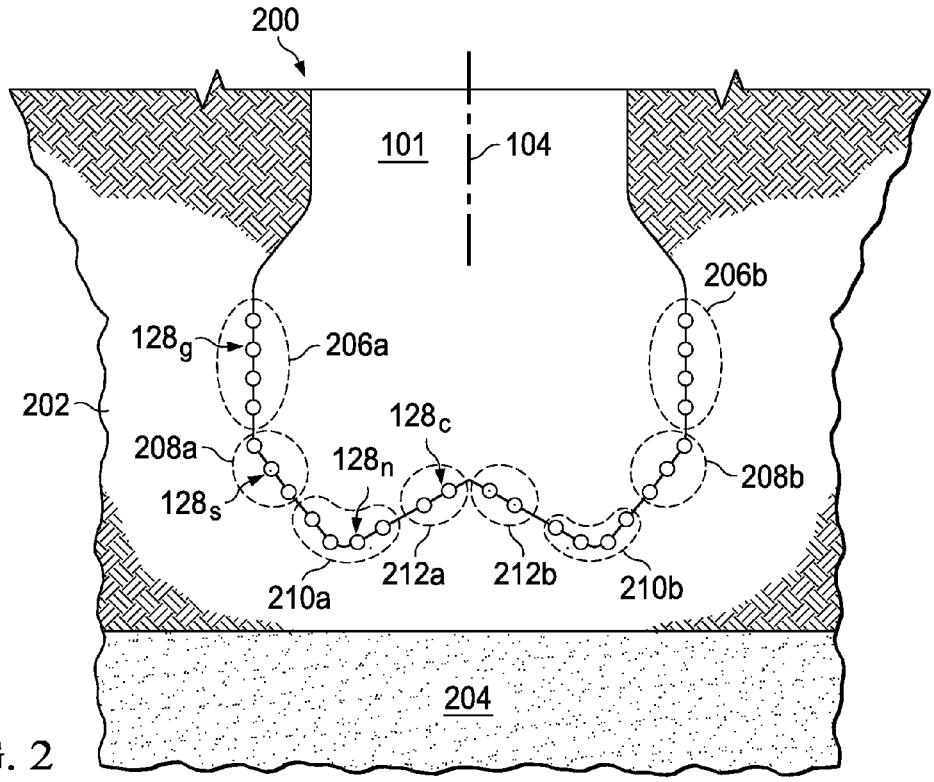
FIG. 2 illustrates a bit face profile of a drill bit forming a wellbore, in accordance with some embodiments of the present disclosure.

FIG. 2 illustrates a bit face profile 200 of drill bit 101 configured to form a wellbore through a first formation layer 202 into a second formation layer 204, in accordance with some embodiments of the present disclosure. Exterior portions of blades (not expressly shown), cutting elements 128 and DOCCs (not expressly shown) may be projected rotationally onto a radial plane to form bit face profile 200. In the illustrated embodiment, formation layer 202 may be described as "softer" or "less hard" when compared to downhole formation layer 204. As shown in FIG. 2, exterior portions of drill bit 101 that contact adjacent portions of a downhole formation may be described as a "bit face." Bit face profile 200 of drill bit 101 may include various zones or segments. Bit face profile 200 may be substantially symmetric about bit rotational axis 104 due to the rotational projection of bit face profile 200, such that the zones or segments on one side of rotational axis 104 may be substantially similar to the zones or segments on the opposite side of rotational axis 104.

For example, bit face profile 200 may include a gage zone 206*a* located opposite a gage zone 206*b*, a shoulder zone 208*a* located opposite a shoulder zone 208*b*, a nose zone 210*a* located opposite a nose zone 210*b*, and a cone zone 212*a* located opposite a cone zone 212*b*. The cutting elements 128 included in each zone may be referred to as cutting elements of that zone. For example, cutting elements $\mathbf{128}_g$ included in gage zones 206 may be referred to as gage cutting elements, cutting elements $\mathbf{128}_s$ included in shoulder zones 208 may be referred to as shoulder cutting elements, cutting elements $\mathbf{128}_n$ included in nose zones 210 may be referred to as nose cutting elements, and cutting elements $\mathbf{128}_c$ included in cone zones 212 may be referred to as cone cutting elements. As discussed in further detail below with respect to FIGS. 3 and 4, each zone or segment along bit face profile 200 may be defined in part by respective portions of associated blades 126.

Cone zones 212 may be generally convex and may be formed on exterior portions of each blade (e.g., blades 126 as illustrated in FIG. 1) of drill bit 101, adjacent to and extending out from bit rotational axis 104. Nose zones 210 may be generally convex and may be formed on exterior portions of each blade of drill bit 101, adjacent to and extending from each cone zone 212. Shoulder zones 208 may be formed on exterior portions of each blade 126 extending from respective nose zones 210 and may terminate proximate to a respective gage zone 206.

According to the present disclosure, a DOCC (not expressly shown) may be configured along bit face profile 200 to provide an improved depth of cut control for cutting elements 128. The design of each DOCC may be based at least partially on the location of each cutting element 128 with respect to a particular zone of the bit face profile 200 (e.g., gage zone 206, shoulder zone 208, nose zone 210 or cone zone 212). Further, as mentioned above, the various zones of bit face profile 200 may be based on the profile of blades 126 of drill bit 101.

Figure 3:
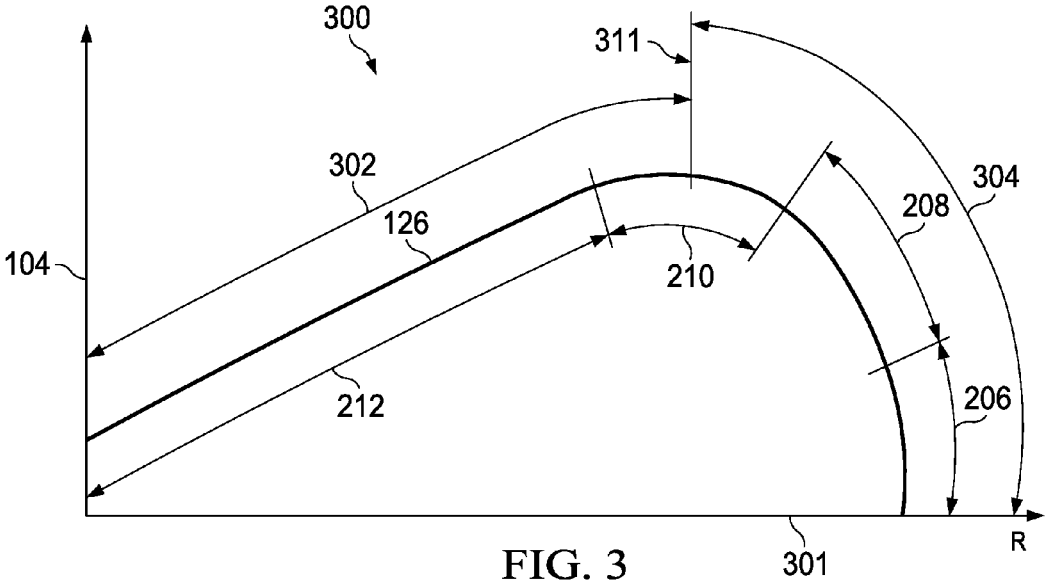
FIG. 3 illustrates a blade profile that may represent a cross-sectional view of a blade of a drill bit, in accordance with some embodiments of the present disclosure.

FIG. 3 illustrates a blade profile 300 that represents a cross-sectional view of a blade 126 of drill bit 101. Blade profile 300 includes a cone zone 212, nose zone 210, shoulder zone 208 and gage zone 206 as described above with respect to FIG. 2. Cone zone 212, nose zone 210, shoulder zone 208 and gage zone 206 may be based on their location along blade 126 with respect to rotational axis 104 and a horizontal reference line 301 that may indicate a distance from rotational axis 104 in a plane perpendicular to rotational axis 104. A comparison of FIGS. 2 and 3 shows that blade profile 300 of FIG. 3 is upside down with respect to bit face profile 200 of FIG. 2.

Blade profile 300 may include an inner zone 302 and an outer zone 304. Inner zone 302 may extend outward from rotational axis 104 to nose point 311. Outer zone 304 may extend from nose point 311 to the end of blade 126. Nose point 311 may be the location on blade profile 300 within nose zone 210 that has maximum elevation as measured by bit rotational axis 104 (vertical axis) from reference line 301 (horizontal axis). A coordinate on the graph in FIG. 3 corresponding to rotational axis 104 may be referred to as an axial coordinate or position. A coordinate on the graph in FIG. 3 corresponding to reference line 301 may be referred to as a radial coordinate or radial position that may indicate a distance extending orthogonally from rotational axis 104 in a radial plane passing through rotational axis 104. For example, in FIG. 3 rotational axis 104 may be placed along a z-axis and reference line 301 may indicate the distance (R) extending orthogonally from rotational axis 104 to a point on a radial plane that may be defined as the ZR plane.

FIGS. 2 and 3 are for illustrative purposes only and modifications, additions or omissions may be made to FIGS. 2 and 3 without departing from the scope of the present disclosure. For example, the actual locations of the various zones with respect to the bit face profile may vary and may not be exactly as depicted.

FIGS. 4A-4D illustrate cutting edges 406 (not expressly labeled in FIG. 4A) and cutting zones 404 of various cutting elements 402 disposed along a blade 400, as modeled by a drilling bit simulator. The location and size of cutting zones 404 (and consequently the location and size of cutting edges 406) may depend on factors including the ROP and RPM of the bit, the size of cutting elements 402, and the location and orientation of cutting elements 402 along the blade profile of blade 400, and accordingly the bit face profile of the drill bit.

Figure 4A:
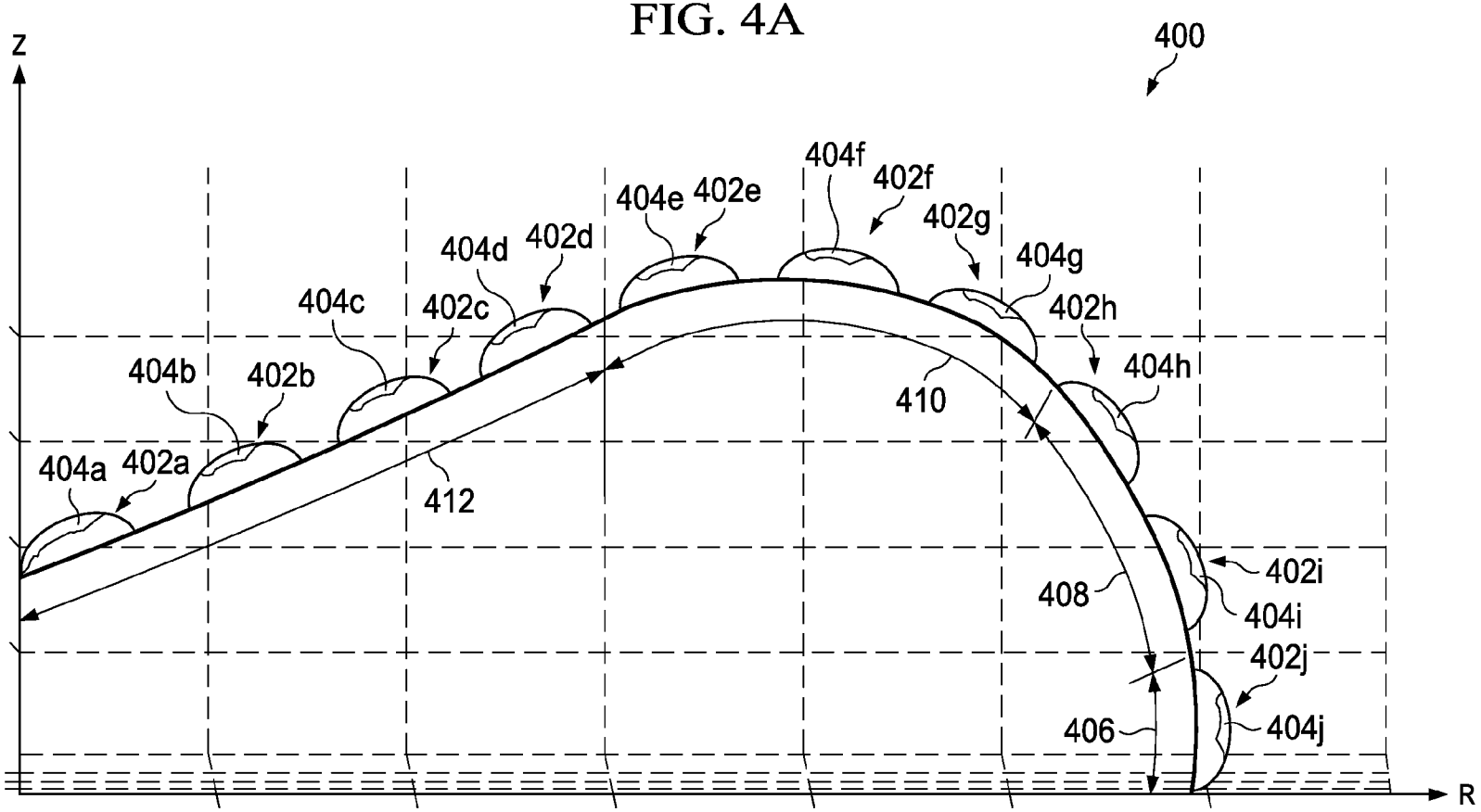
FIGS. 4A-4D illustrate cutting zones of various cutting elements disposed along a blade, in accordance with some embodiments of the present disclosure.

FIG. 4A illustrates a graph of a profile of a blade 400 indicating radial and axial locations of cutting elements 402*a*-402*j* along blade 400. The vertical axis depicts the axial position of blade 400 along a bit rotational axis and the horizontal axis depicts the radial position of blade 400 from the bit rotational axis in a radial plane passing through and perpendicular to the bit rotational axis. Blade 400 may be substantially similar to one of blades 126 described with respect to FIGS. 1-3 and cutting elements 402 may be substantially similar to cutting elements 128 described with respect to FIGS. 1-3. In the illustrated embodiment, cutting elements 402*a*-402*d* may be located within a cone zone 412 of blade 400 and cutting elements 402*e*-402*g* may be located within a nose zone 410 of blade 400. Additionally, cutting elements 402*h*-402*i* may be located within a shoulder zone 408 of blade 400 and cutting element 402*j* may be located within a gage zone 406 of blade 400. Cone zone 412, nose zone 410, shoulder zone 408 and gage zone 406 may be substantially similar to cone zone 212, nose zone 210, shoulder zone 208 and gage zone 206, respectively, described with respect to FIGS. 2 and 3.

FIG. 4A illustrates cutting zones 404*a*-404*j*, with each cutting zone 404 corresponding with a respective cutting element 402. As mentioned above, each cutting element 202 may have a cutting edge (not expressly shown) located within a cutting zone 404. From FIG. 4A it can be seen that the cutting zone 404 of each cutting element 402 may be based on the axial and radial locations of the cutting element 402 on blade 400, which may be related to the various zones of blade 400.

Figure 4B:
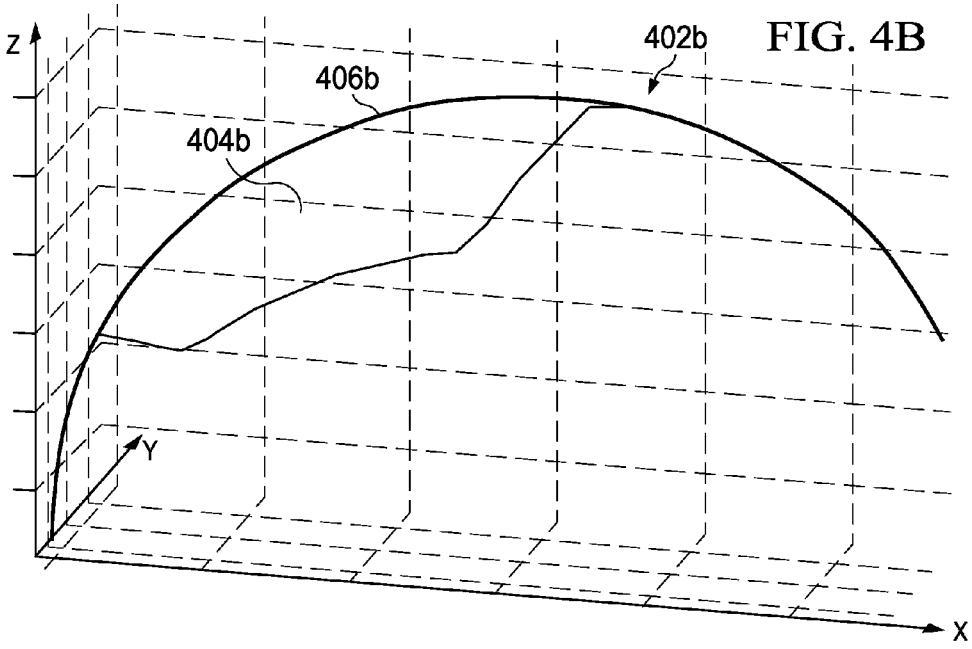

FIG. 4B illustrates an exploded graph of cutting element 402*b* of FIG. 4A to better illustrate cutting zone 404*b* and cutting edge 406*b* associated with cutting element 402*b*. From FIG. 4A it can be seen that cutting element 402*b* may be located in cone zone 412. Cutting zone 404*b* may be based at least partially on cutting element 402*b* being located in cone zone 412 and having axial and radial positions corresponding with cone zone 412. As mentioned above, cutting edge 406*b* may be the edge of the cutting surface of cutting element 402*b* that is located within cutting zone 404*b*.

Figure 4C:
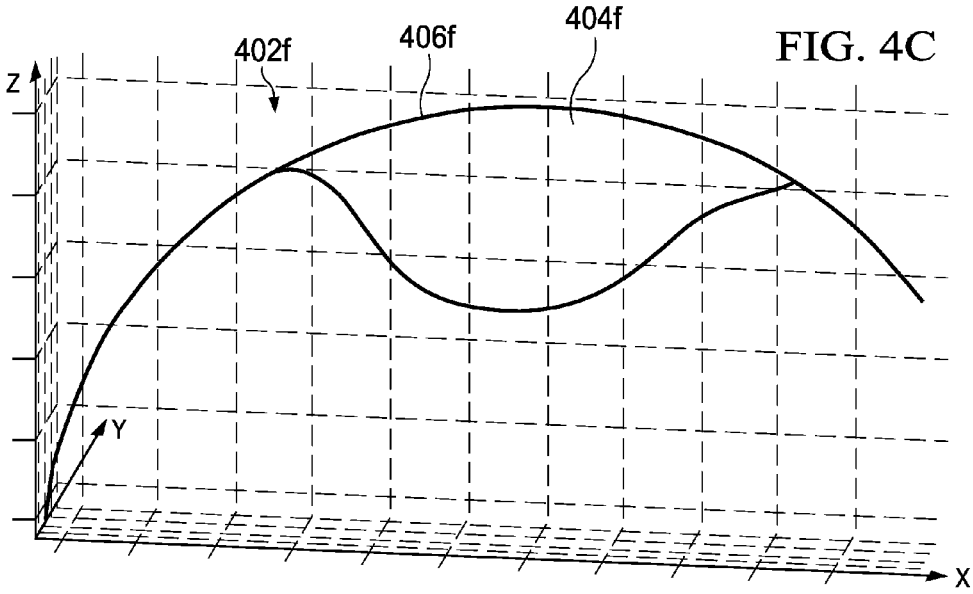

FIG. 4C illustrates an exploded graph of cutting element 402*f* of FIG. 4A to better illustrate cutting zone 404*f* and cutting edge 406*f* associated with cutting element 402*f*. From FIG. 4A it can be seen that cutting element 402*f* may be located in nose zone 410. Cutting zone 404*f* may be based at least partially on cutting element 402*f* being located in nose zone 410 and having axial and radial positions corresponding with nose zone 410.

Figure 4D:
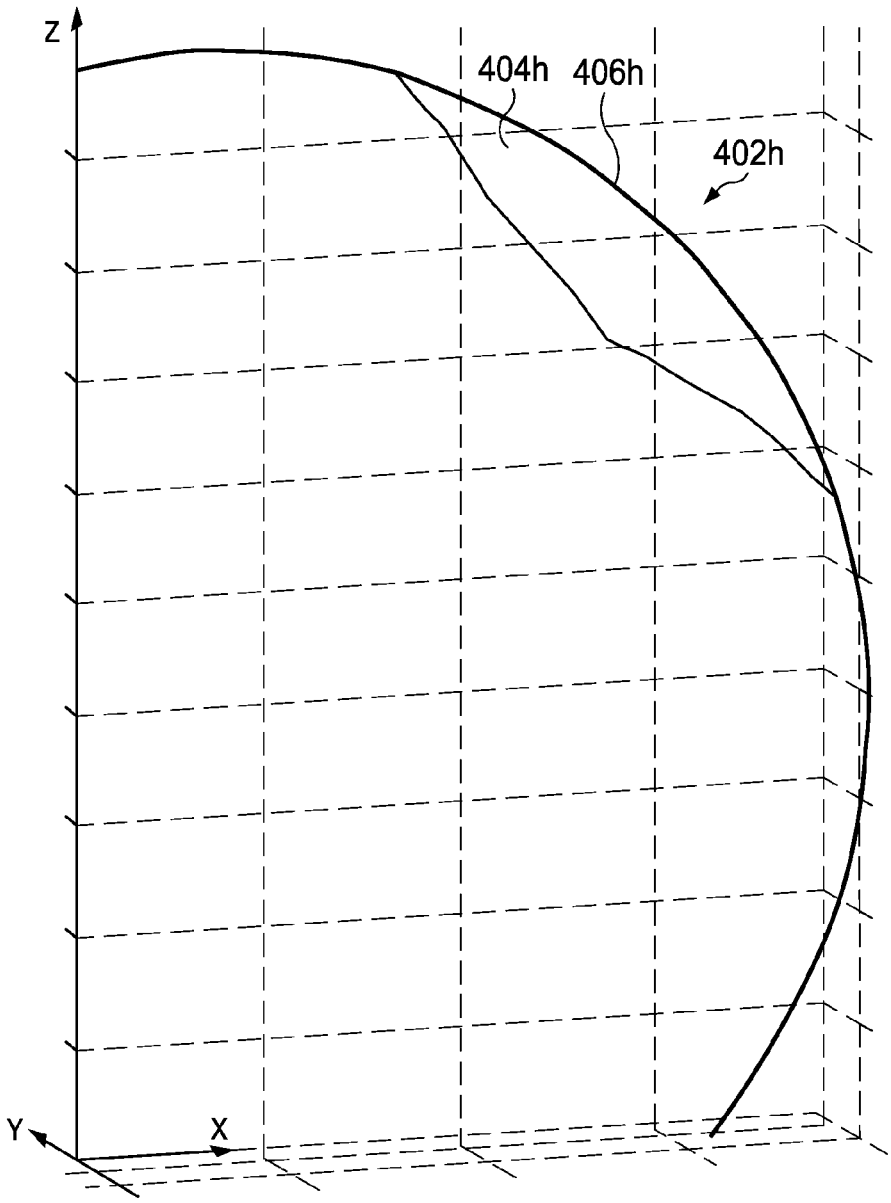

FIG. 4D illustrates an exploded graph of cutting element 402*h* of FIG. 4A to better illustrate cutting zone 404*h* and cutting edge 406*h* associated with cutting element 402*h*. From FIG. 4A it can be seen that cutting element 402*h* may be located in shoulder zone 408. Cutting zone 404*h* may be based partially on cutting element 402*h* being located in shoulder zone 408 and having axial and radial positions corresponding with shoulder zone 408.

An analysis of FIG. 4A and a comparison of FIGS. 4B-4D reveal that the locations of cutting zones 404 of cutting elements 402 may vary at least in part on the axial and radial positions of cutting elements 402 with respect to rotational axis 104. Accordingly, the location, orientation and configuration of a DOCC for a drill bit may take into consideration the locations of the cutting zones (and their associated cutting edges) of the cutting elements that may overlap the rotational path of a DOCC.

Figure 5:
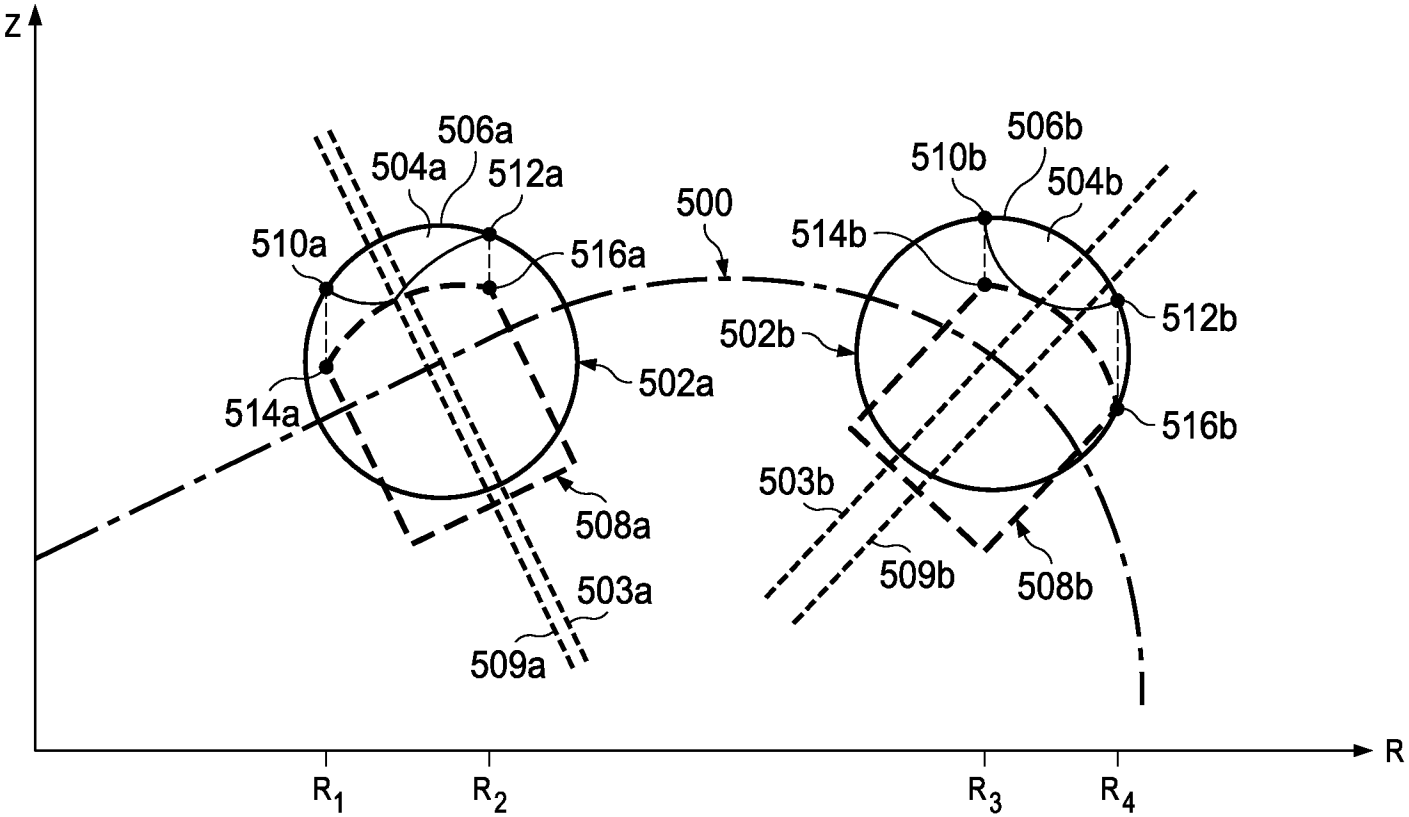
FIG. 5 illustrates a graph of a profile of a blade indicating the locations of cutting elements and depth of cut controllers (DOCCs) along the blade, in accordance with some embodiments of the present disclosure.

FIG. 5 illustrates a graph of a profile of a blade 500 indicating radial and axial locations of cutting elements 502*a* and 502*b*, and DOCCs 508*a* and 508*b* along blade 500. The vertical axis (z-axis) depicts an axial position along a bit rotational axis of a drill bit associated with blade 500, cutting elements 502 and DOCCs 508. The horizontal axis or radial axis (R-axis) of FIG. 5 depicts a radial position from the bit rotational axis in a radial plane passing through and perpendicular to the bit rotational axis. In the illustrated embodiment, cutting element 502*a* and DOCC 508*a* may be located within a cone zone of blade 500 and cutting element 502*b* and DOCC 508*b* may be located within a shoulder zone of blade 500.

Cutting elements 502*a* and 502*b* may include cutting zones 504*a* and 504*b*, respectively, that may have associated cutting edges 506*a* and 506*b*, respectively, similar to cutting zones 404 and cutting edges 406 described above with respect to FIGS. 4A-4D. As illustrated in FIG. 5, the positions of cutting zones 504 and cutting edges 506 with respect to their associated cutting element 502 may depend on the position of the respective cutting element 502 along blade 500. Additionally, as described in further detail below, the radial positions of DOCCs 508*a* and 508*b* may be configured according to the radial positions of cutting edges 506*a* and 506*b* of cutting elements 502*a* and 502*b*, respectively.

For example, DOCC 508*a* may be configured such that an inner point 514*a* of the surface of DOCC 508*a* is located at approximately the same radial location (depicted as $R_1$ in FIG. 5) as an inner point 510*a* of cutting edge 506*a* of cutting element 502*a*. Additionally, DOCC 508*a* may be configured such that an outer point 516*a* of the surface of DOCC 508*a* is located at approximately the same radial location (depicted as $R_2$ in FIG. 5) as an outer point 512*a* of cutting edge 506*a* of cutting element 502*a*. DOCC 508*b* may be similarly configured such that an inner point 514*b* and an outer point 516*b* of the surface of DOCC 508*b* may be located at approximately the same radial locations (depicted as $R_3$ and $R_4$, respectively, in FIG. 5) as inner point 510*b* and outer point 512*b*, respectively, of cutting edge 506*b* of cutting element 502*b*. Therefore, radial positions of DOCCs 508*a* and 508*b* may be based on the radial positions of cutting edges 506*a* and 506*b* of cutting elements 502*a* and 502*b*, respectively. Additionally, the sizes of DOCCs 508*a* and 508*b* may be determined and selected such that DOCCs 508*a* and 508*b* substantially overlap cutting zones 504*a* and 504*b* of cutting elements 502*a* and 502*b*, respectively.

By configuring DOCCs 508*a* and 508*b* based on the radial positions of cutting zones 504*a* and 504*b* and cutting edges 506*a* and 506*b*, respectively, DOCCs 508*a* and 508*b* may be radially aligned with cutting zones 504*a* and 504*b*, respectively. Therefore, in instances where cutting zones 504*a* and 504*b* may not be located in the middle of cutting elements 502*a* and 502*b*, respectively, DOCCs 508*a* and 508*b* may be radially offset from the centers of cutting elements 502*a* and 502*b*, respectively. In contrast, traditional DOCC placement methods may merely align a DOCC with a respective cutting element, but not configure the DOCC with respect to the location of the cutting zone and cutting edge of the cutting element.

In the present disclosure, center line 503*a* of FIG. 5 may be located in the middle of cutting element 502*a* and center line 509*a* may be located in the middle of DOCC 508*a*. As shown in FIG. 5, center line 503*a* associated with cutting element 502*a* may be offset from center line 509*a* associated with DOCC 508*a* because the location of DOCC 508*a* may be based on the location of cutting zone 504*a* and cutting edge 506*a* of cutting element 502*a*. Center lines 503*b* and 509*b* associated with cutting element 502*b* and DOCC 508*b*, respectively, show a similar type of offset. Further, as described in further detail below, the axial positions of DOCCs 508*a* and 508*b* may be configured using a critical depth of cut control curve (CDCCC) calculation. The CDCCC calculation may be based at least partially on an underexposure of the axial positions of DOCCs 508*a* and 508*b* with respect to the axial positions of cutting edges 506*a* and 506*b*, respectively, of cutting elements 502*a* and 502*b*, respectively. Therefore, the axial positions of DOCCs 508*a* and 508*b* may be determined based at least partially on the axial positions of cutting edges 506*a* and 506*b*, respectively, of cutting elements 502*a* and 502*b*, respectively.

As described in further detail below, by configuring DOCCs 508*a* and 508*b* based on the radial and axial locations of cutting edges 506*a* and 506*b* of cutting elements 502*a* and 502*b*, respectively, the depth of cut control of cutting elements 502*a* and 502*b* may be improved.

Modifications, additions, or omissions may be made to FIG. 5 without departing from the scope of the present disclosure. For example, although a certain number of cutting elements 502 and DOCCs 508 are depicted, blade 500, may include any suitable number of cutting elements 502 and DOCCs 508. Further, DOCCs 508 and cutting elements 502 may be disposed on the same blade 500 in some embodiments, and in other embodiments, any combination of cutting elements 502 and DOCCs 508 may be disposed on different blades. Additionally, the CDCCC calculation may consider the cutting zones 504 and cutting edges 506 of other cutting elements 502 with a depth of cut that may be affected by a DOCC 508. Therefore, the DOCC 508 may be configured based on the locations of cutting zones 504 and cutting edges 506 of a plurality of cutting elements 502. Further, the principles described above with respect to determining the axial and radial positions of DOCCs may also be used to determine the axial and radial positions of back up cutting elements.

Figure 6A:
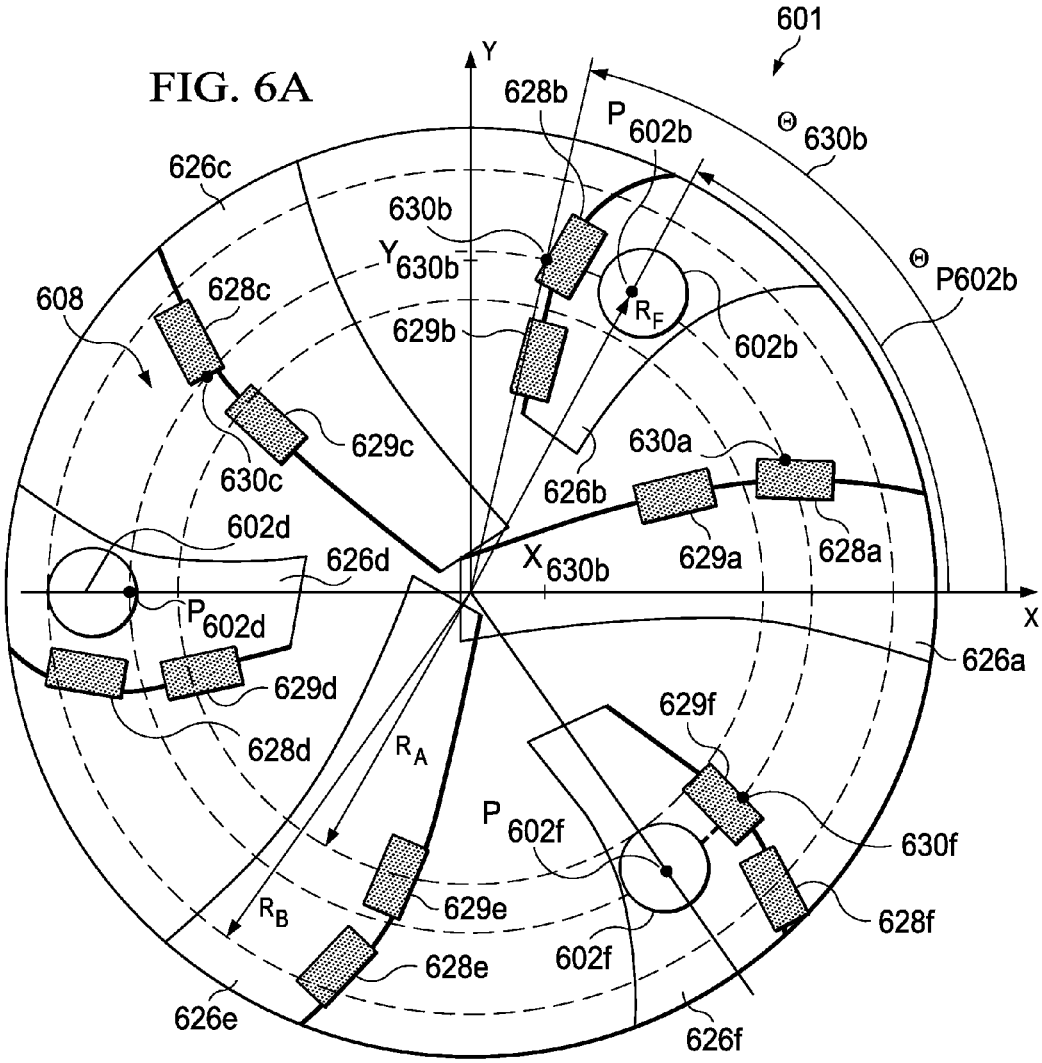
FIG. 6A illustrates the face of a drill bit for which a critical depth of cut control curve (CDCCC) may be determined, in accordance with some embodiments of the present disclosure.
Figure 6B:
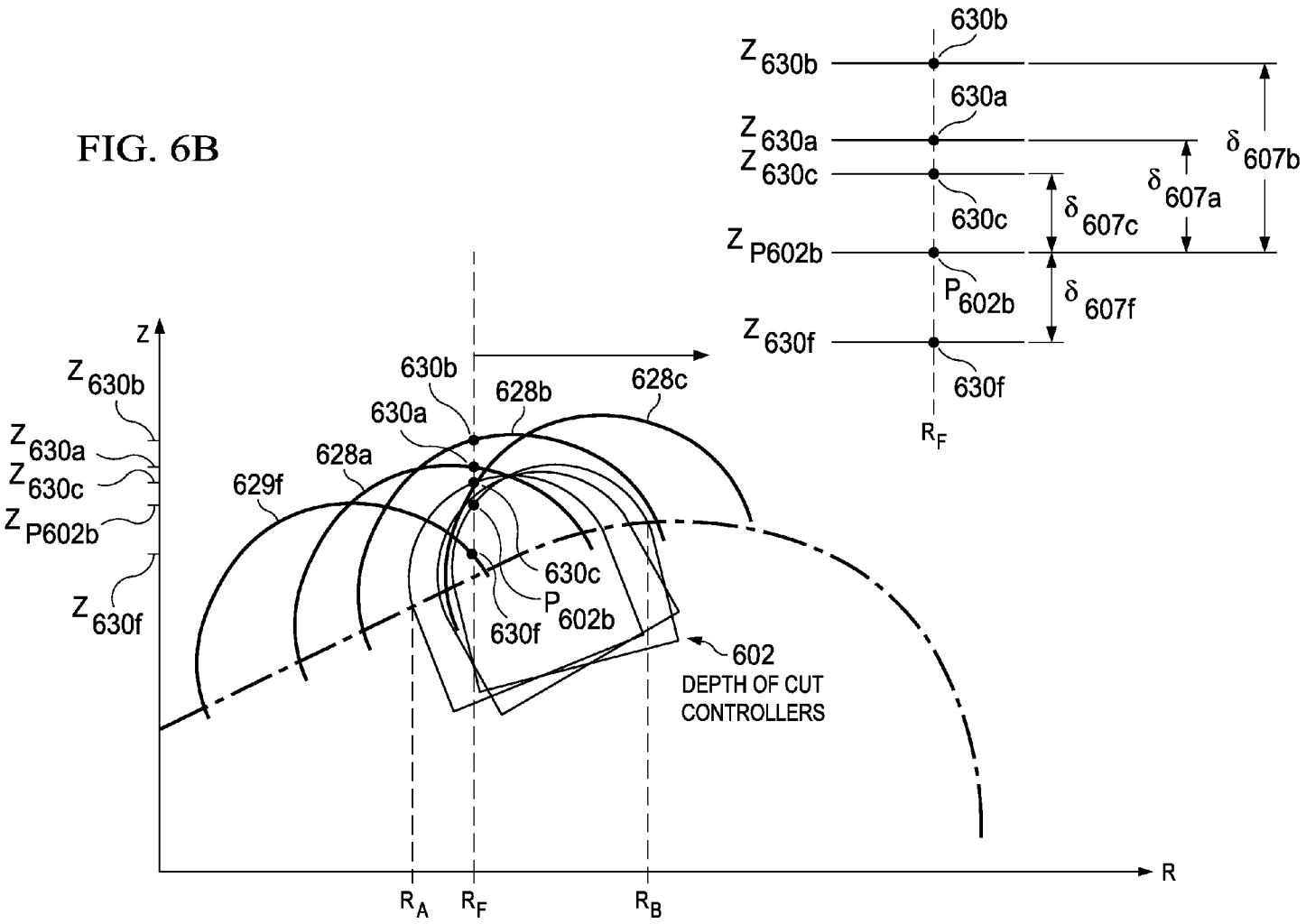
FIG. 6B illustrates a bit face profile of the drill bit of FIG. 6A, in accordance with some embodiments of the present disclosure.

FIG. 6A illustrates the face of a drill bit 601 for which a critical depth of cut control curve (CDCCC) may be determined, in accordance with some embodiments of the present disclosure. FIG. 6B illustrates a bit face profile of drill bit 601 of FIG. 6A.

To provide a frame of reference, FIG. 6B includes a z-axis that may represent the rotational axis of drill bit 601. Accordingly, a coordinate or position corresponding to the z-axis of FIG. 6B may be referred to as an axial coordinate or axial position of the bit face profile depicted in FIG. 6B. FIG. 6B also includes a radial axis (R) that indicates the orthogonal distance from the rotational axis, of drill bit 601.

Additionally, a location along the bit face of drill bit 601 shown in FIG. 6A may be described by x and y coordinates of an xy-plane of FIG. 6A. The xy-plane of FIG. 6A may be substantially perpendicular to the z-axis of FIG. 6B such that the xy-plane of FIG. 6A may be substantially perpendicular to the rotational axis of drill bit 601. Additionally, the x-axis and y-axis of FIG. 6A may intersect each other at the z-axis of FIG. 6B such that the x-axis and y-axis may intersect each other at the rotational axis of drill bit 601.

The distance from the rotational axis of the drill bit 601 to a point in the xy plane of the bit face of FIG. 6A may indicate the radial coordinate or radial position of the point on the bit face profile depicted in FIG. 6B. For example, the radial coordinate, r, of a point in the xy plane having an x coordinate, x, and a y coordinate, y, may be expressed by the following equation:

$$r=\sqrt{x^2+y^2}$$

Additionally, a point in the xy plane (of FIG. 6A) may have an angular coordinate that may be an angle between a line extending orthogonally from the rotational axis of drill bit 601 to the point and the x-axis. For example, the angular coordinate (θ) of a point in the xy plane (of FIG. 6B) having an x-coordinate, x, and a y-coordinate, y, may be expressed by the following equation:

$$\theta=\arctan(y/x)$$

As a further example, as illustrated in FIG. 6A, a cutlet point 630*b* (described in further detail below) associated with a cutting edge of cutting element 628*b* may have an x-coordinate ($X_{630b}$) and a y-coordinate ($Y_{630b}$) in the xy plane. $X_{630b}$ and $Y_{630b}$ may be used to calculate a radial coordinate ($R_F$) of cutlet point 630*b* (e.g., $R_F$ may be equal to the square root of $X_{630b}$ squared plus $Y_{630b}$ squared). $R_F$ may accordingly indicate an orthogonal distance of cutlet point 630*b* from the rotational axis of drill bit 601.

Additionally, cutlet point 630*b* may have an angular coordinate ($\theta_{630b}$) that may be the angle between the x-axis and the line extending orthogonally from the rotational axis of drill bit 601 to cutlet point 630*b* (e.g., $\theta_{630b}$ may be equal to arctan ($X_{630b}/Y_{630b}$)). Further, as depicted in FIG. 6B, cutlet point 630*b* may have an axial coordinate ($Z_{630b}$) that may represent a position of cutlet point 630*b* along the rotational axis of drill bit 601.

The cited coordinates and coordinate systems are used for illustrative purposes only, and any other suitable coordinate system or configuration, may be used to provide a frame of reference of points along the bit face profile and bit face of a drill bit associated with FIGS. 6A and 6B, without departing from the scope of the present disclosure. Additionally, any suitable units may be used. For example, the angular position may be expressed in degrees or in radians.

Returning to FIG. 6A, drill bit 601 may include a plurality of blades 626 that may include cutting elements 628 and 629. Additionally, blades 626*b*, 626*d* and 626*f* may include DOCC 602*b*, DOCC 602*d* and DOCC 602*f*, respectively, that may be configured to control the depth of cut of drill bit 601. In the illustrated embodiment, DOCCs 602*a*, 602*d* and 602*f* may have radial and angular locations that are based on the angular and radial locations of the cutting zones of cutting elements 628*b*, 628*d*, and 629*f*, respectively. For example, DOCCs 602*a*, 602*d*, and 602*f* may be placed on blades 626*b*, 626*d*, and 626*f*, such that the radial positions of DOCCs 602*a*, 602*d*, and 602*f* may be substantially aligned radially with the cutting zones of cutting elements 628*b*, 628*d*, and 629*f*, respectively. Further, the angular positions of DOCCs 602*a*, 602*d*, and 602*f* may be such that DOCCs 602*a*, 602*d*, and 602*f* are placed behind (with respect to the rotational direction of drill bit 601) the cutting zones of cutting elements 628*b*, 628*d*, and 629*f*, respectively. In other embodiments, the angular positions of DOCCs 602*a*, 602*d*, and 602*f* may be such that DOCCs 602*a*, 602*d*, and 602*f* are placed in front of (with respect to the rotational direction of drill bit 601) the cutting zones of cutting elements 628*b*, 628*d*, and 629*f*, respectively. In further embodiments, the angular positions of DOCCs 602*a*, 602*d*, and 602*f* may be such that DOCCs 602*a*, 602*d*, and 602*f* are placed substantially opposite of (with respect to the rotational direction of drill bit 601) the cutting zones of cutting elements 628*b*, 628*d*, and 629*f*, respectively. For example, DOCC 602*b* may be placed on blade 626*e* such that DOCC 602*b* is substantially opposite of the cutting zone of cutting element 628*b*.

As mentioned above, the critical depth of cut of drill bit 601 may be determined for a radial location along drill bit 601. For example, drill bit 601 may include a radial coordinate $R_F$ that may intersect with DOCC 602*b* at a control point $P_{602b}$, DOCC 602*d* at a control point $P_{602d}$, and DOCC 602*f* at a control point $P_{602f}$. Additionally, radial coordinate $R_F$ may intersect cutting elements 628*a*, 628*b*, 628*c*, and 629*f* at cutlet points 630*a*, 630*b*, 630*c*, and 630*f*, respectively, of the cutting edges of cutting elements 628*a*, 628*b*, 628*c*, and 629*f*, respectively.

The angular coordinates of control points $P_{602b}$, $P_{602d}$ and $P_{602f}$($\theta_{P602b}$, $\theta_{P602d}$ and $\theta_{P602f}$, respectively) may be determined along with the angular coordinates of cutlet points 630*a*, 630*b*, 630*c* and 630*f* ($\theta_{630a}$, $\theta_{630b}$, $\theta_{630c}$ and $\theta_{630f}$, respectively). A depth of cut control provided by each of control points $P_{602b}$, $P_{602d}$ and $P_{602f}$ with respect to each of cutlet points 630*a*, 630*b*, 630*c* and 630*f* may be determined. The depth of cut control provided by each of control points $P_{602b}$, $P_{602d}$ and $P_{602f}$ may be based on the underexposure ($\delta_{607i}$ depicted in FIG. 6B) of each of points $P_{602i}$ with respect to each of cutlet points 630 and the angular coordinates of points $P_{602i}$ with respect to cutlet points 630.

For example, the depth of cut of cutting element 628*b* at cutlet point 630*b* controlled by point $P_{602b}$ of DOCC 602*b* ($\Delta_{630b}$) may be determined using the angular coordinates of point $P_{602b}$ and cutlet point 630*b* ($\theta_{P602b}$ and $\theta_{630b}$, respectively), which are depicted in FIG. 6A. Additionally, $\Delta_{630b}$ may be based on the axial underexposure ($\delta_{607b}$) of the axial coordinate of point $P_{602b}$($Z_{P602b}$) with respect to the axial coordinate of intersection point 630*b* ($Z_{630b}$), as depicted in FIG. 6B. In some embodiments, $\Delta_{630b}$ may be determined using the following equations:

$$\Delta_{630b}=\delta_{607b}*360/(360-(\theta_{P602b}-\theta_{630b}));\text{ and}$$

$$\delta_{607b}=Z_{630b}-ZP_{602b}.$$

In the first of the above equations, $\theta_{P602b}$ and $\theta_{630b}$ may be expressed in degrees and "360" may represent a full rotation about the face of drill bit 601. Therefore, in instances where $\theta_{P602b}$ and $\theta_{630b}$ are expressed in radians, the numbers "360" in the first of the above equations may be changed to "2π." Further, in the above equation, the resultant angle of "($\theta_{P602b}-\theta_{630b}$)" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$. Similar equations may be used to determine the depth of cut of cutting elements 628*a*, 628*c*, and 629*f* as controlled by control point $P_{602b}$ at cutlet points 630*a*, 630*c* and 630*f*, respectively ($\Delta_{630a}$, $\Delta_{630c}$ and $\Delta_{630f}$, respectively).

The critical depth of cut provided by point $P_{602b}$($\Delta_{P602b}$) may be the maximum of $\Delta_{630a}$, $\Delta_{630b}$, $\Delta_{630c}$ and $\Delta_{630f}$ and may be expressed by the following equation:

$$\Delta_{P602b}=\max[\Delta_{630a},\Delta_{630b},\Delta_{630c},\Delta_{630f}].$$

The critical depth of cut provided by points $P_{602d}$ and $P_{602f}$($\Delta_{P602d}$ and $\Delta_{P602f}$, respectively) at radial coordinate $R_F$ may be similarly determined. The overall critical depth of cut of drill bit 601 at radial coordinate $R_F$ ($\Delta_{RF}$) may be based on the minimum of $\Delta_{p602b}$, $\Delta_{P602d}$ and $\Delta_{P602f}$ and may be expressed by the following equation:

$$\Delta_{RF}=\min[\Delta_{P602b},\Delta_{P602d},\Delta_{P602f}].$$

Accordingly, the overall critical depth of cut of drill bit 601 at radial coordinate $R_F$ ($\Delta_{RF}$) may be determined based on the points where DOCCs 602 and cutting elements 628/629 intersect $R_F$. Although not expressly shown here, it is understood that the overall critical depth of cut of drill bit 601 at radial coordinate $R_F$ ($\Delta_{RF}$) may also be affected by control points $P_{626i}$ (not expressly shown in FIGS. 6A and 6B) that may be associated with blades 626 configured to control the depth of cut of drill bit 601 at radial coordinate $R_F$. In such instances, a critical depth of cut provided by each control point $P_{626i}$ ($\Delta_{P626i}$) may be determined. Each critical depth of cut $\Delta_{P626i}$ for each control point $P_{626i}$ may be included with critical depth of cuts $\Delta_{P602i}$ in determining the minimum critical depth of cut at $R_F$ to calculate the overall critical depth of cut $\Delta_{RF}$ at radial location $R_F$.

Figure 6C:
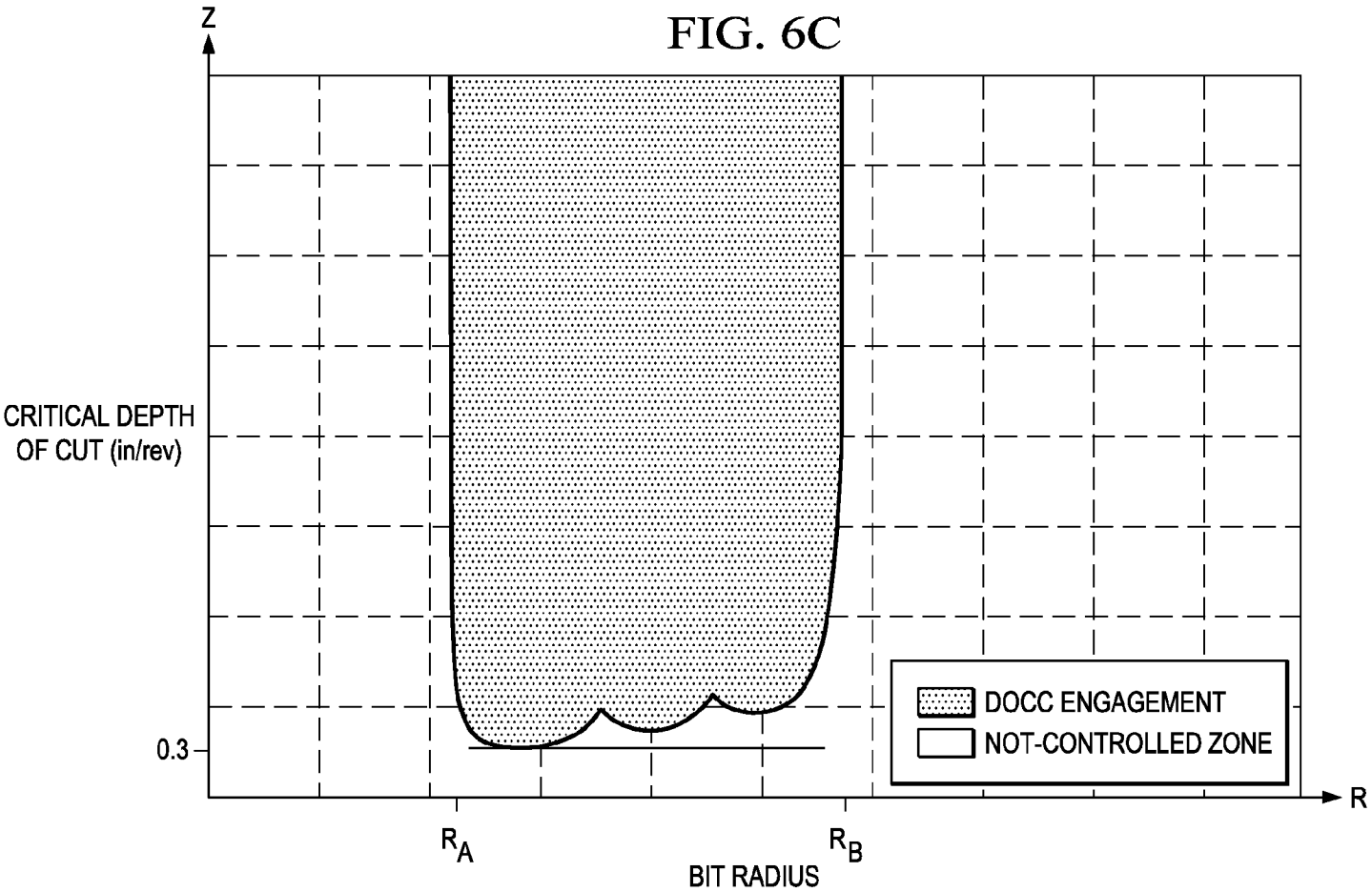
FIGS. 6C and 6D illustrate critical depth of cut control curves of the drill bit of FIG. 6A.
Figure 6D:
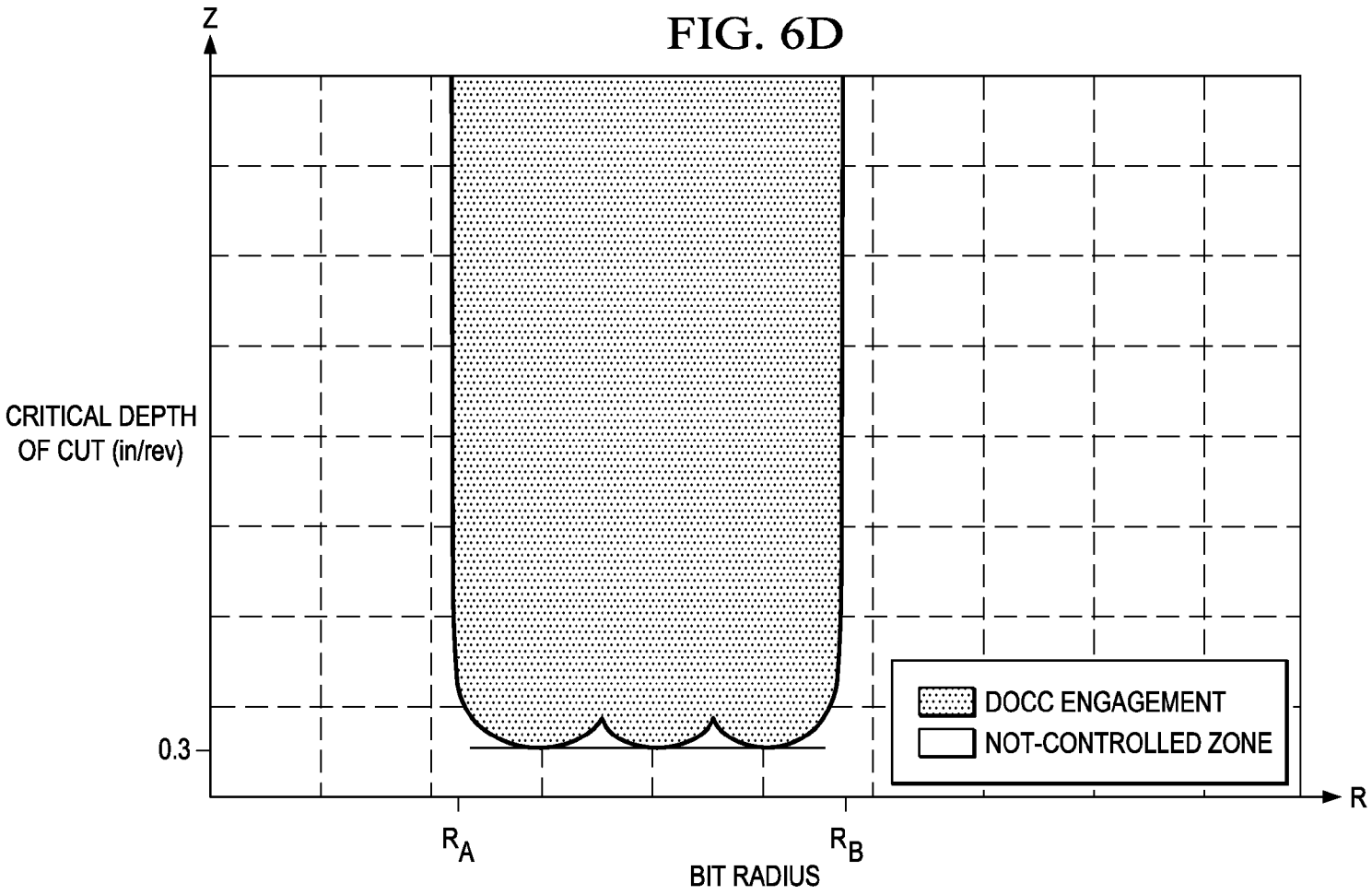

To determine a critical depth of cut control curve of drill bit 601, the overall critical depth of cut at a series of radial locations $R_f$($\Delta_{Rf}$) anywhere from the center of drill bit 601 to the edge of drill bit 601 may be determined to generate a curve that represents the critical depth of cut as a function of the radius of drill bit 601. In the illustrated embodiment, DOCCs 602*b*, 602*d*, and 602*f* may be configured to control the depth of cut of drill bit 601 for a radial swath 608 defined as being located between a first radial coordinate $R_A$ and a second radial coordinate $R_B$. Accordingly, the overall critical depth of cut may be determined for a series of radial coordinates $R_f$ that are within radial swath 608 and located between $R_A$ and $R_B$, as disclosed above. Once the overall critical depths of cuts for a sufficient number of radial coordinates $R_f$ are determined, the overall critical depth of cut may be graphed as a function of the radial coordinates $R_f$. FIGS. 6C and 6D illustrate critical depth of cut control curves where the critical depth of cut is plotted as a function of the bit radius, in accordance with some embodiments of the present disclosure.

As mentioned above, the critical depth of cut control curve may be used to determine the minimum critical depth of cut control as provided by the DOCCs and/or blades of a drill bit. For example, FIGS. 6C and 6D both illustrate a critical depth of cut control curve for drill bit 601 between radial coordinates $R_A$ and $R_B$. The z-axis in FIGS. 6C and 6D may represent the rotational axis of drill bit 601, and the radial (R) axis may represent the radial distance from the rotational axis of drill bit 601.

FIG. 6C illustrates a critical depth of cut control curve where the axial positions of one or more of DOCCs 602 of drill bit 601 have not yet been configured by using the CDCCC. As shown in FIG. 6C the minimum critical depth of cut provided by DOCCs 602 may not be the same or even. Additionally, in the illustrated embodiment, the desired minimum critical depth of cut for each DOCC 602 may be 0.3 inches/revolution (in/rev). However, FIG. 6C indicates that only one of the three DOCCs 602 may be substantially close to providing a minimum critical depth of cut of 0.3 in/rev. Accordingly, the critical depth of cut control curve of FIG. 6C indicates that a modification may be made to DOCCs 602 such that the minimum critical depth of cut provided by each of DOCCs 602 may be substantially equal.

For example, as shown in FIG. 6A, DOCC 602*f* may be radially located closest to the rotational axis of drill bit 601 with respect to DOCCs 602*b* and 602*d*, DOCC 602*d* may be radially located furthest from the rotational axis of drill bit 601 with respect to DOCC 602*b* and DOCC 602*f*, and DOCC 602*b* may be radially located between the radial locations of DOCCs 602*f* and 602*d*. Accordingly, the lowest point on the bump closest to the z-axis of the CDCCC in FIG. 6C may indicate the minimum depth of cut control provided by DOCC 602*f*, the lowest point on the middle bump of the CDCCC may indicate the minimum critical depth of cut as provided by DOCC 602*b*, and the lowest point on the bump furthest from the z-axis of the CDCCC may indicate the minimum depth of cut control provided by DOCC 602*d*.

As mentioned above, in the current embodiment, the desired minimum depth of cut control provided by each of DOCCs 602 may be 0.3 in/rev. Therefore, based on the CDCCC of FIG. 6C, the axial position of DOCCs 602*b* and 602*d* may be adjusted such that DOCCs 602*b* and 602*d* may provide the desired minimum critical depth of cut of 0.3 in/rev. After adjusting the axial positions of DOCCs 602*b* and 602*d*, the CDCCC may be calculated again to determine whether DOCCs 602*b* and 602*d* have minimum critical depths of cut that may be substantially equal to the desired minimum depth of cut of 0.3 in/rev. The process may be repeated as many times as necessary to achieve the desired result. FIG. 6D illustrates a CDCCC where DOCCs 602*b*, 602*d* and 602*f* of drill bit 601 have been adjusted accordingly such that each of DOCCs 602*b*, 602*d*, and 602*f* have a minimum critical depth of cut that is substantially equal to the desired minimum depth of cut of 0.3 in/rev of this particular embodiment.

FIG. 6D illustrates that by analyzing a CDCCC and adjusting the axial position of one or more DOCCs 602, the minimum critical depths of cut depth provided by each of DOCCs 602 may be substantially equal. Additionally, such adjustments may result in each DOCC 602 substantially providing a desired minimum critical depth of cut. Further, as detailed above, the CDCCC calculation may consider the cutting zones of each cutting element with a depth of cut that may be controlled by a DOCC 602. Therefore, in some embodiments, by configuring a DOCC 602 based on the CDCCC, a DOCC 602 may be configured based on a plurality of cutting elements, which is not traditionally done. Accordingly, the CDCCC may be used to improve the depth of cut control of a drill bit.

Modifications, additions or omissions may be made to FIGS. 6A-6D without departing from the scope of the present disclosure. For example, as discussed above, blades 626, DOCCs 602 or any combination thereof may affect the critical depth of cut at one or more radial coordinates and the CDCCC may be determined accordingly. Additionally, a CDCCC may be similarly used to determine a desired axial position of a back up cutting element. Further, the above description of the CDCCC calculation may be used to determine a CDCCC of any suitable drill bit.

FIG. 7 illustrates an example method 700 of determining and generating a CDCCC in accordance with some embodiments of the present disclosure. The steps of method 700 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

In the illustrated embodiment, the cutting structures of the drill bit, including at least the locations and orientations of all cutting elements and DOCCs, may have been previously designed. However in other embodiments, method 700 may include steps for designing the cutting structure of the drill bit. For illustrative purposes, method 700 is described with respect to drill bit 601 of FIGS. 6A-6D; however, method 700 may be used to determine the CDCCC of any suitable drill bit.

Method 700 may start, and at step 702, the engineering tool may select a radial swath of drill bit 601 for analyzing the critical depth of cut within the selected radial swath. In some instances the selected radial swath may include the entire face of drill bit 601 and in other instances the selected radial swath may be a portion of the face of drill bit 601. For example, the engineering tool may select radial swath 608 as defined between radial coordinates $R_A$ and $R_B$ and controlled by DOCCs 602*b*, 602*d* and 602*f*, shown in FIGS. 6A-6D.

At step 704, the engineering tool may divide the selected radial swath (e.g., radial swath 608) into a number, Nb, of radial coordinates ($R_f$) such as radial coordinate $R_F$ described in FIGS. 6A and 6B. For example, radial swath 608 may be divided into nine radial coordinates such that Nb for radial swath 608 may be equal to nine. The variable "f" may represent a number from one to Nb for each radial coordinate within the radial swath. For example, "$R_1$" may represent the radial coordinate of the inside edge of a radial swath. Accordingly, for radial swath 608, "$R_1$" may be approximately equal to $R_A$. As a further example, "$R_{Nb}$" may represent the radial coordinate of the outside edge of a radial swath. Therefore, for radial swath 608, "R" may be approximately equal to $R_B$.

At step 706, the engineering tool may select a radial coordinate $R_f$ and may identify control points ($P_i$) at may be located at the selected radial coordinate $R_f$ and associated with a DOCC and/or blade. For example, the engineering tool may select radial coordinate $R_F$ and may identify control points $P_{602i}$ and $P_{626i}$ associated with DOCCs 602 and/or blades 626 and located at radial coordinate $R_F$, as described above with respect to FIGS. 6A and 6B.

At step 708, for the radial coordinate $R_f$ selected in step 706, the engineering tool may identify cutlet points ($C_j$) each located at the selected radial coordinate $R_F$ and associated with the cutting edges of cutting elements. For example, the engineering tool may identify cutlet points 630*a*, 630*b*, 630*c* and 630*f* located at radial coordinate $R_F$ and associated with the cutting edges of cutting elements 628*a*, 628*b*, 628*c*, and 629*f*, respectively, as described and shown with respect to FIGS. 6A and 6B.

At step 710 the engineering tool may select a control point $P_i$ and may calculate a depth of cut for each cutlet $C_j$ as controlled by the selected control point $P_i$ ($\Delta_{Cj}$), as described above with respect to FIGS. 6A and 6B. For example, the engineering tool may determine the depth of cut of cutlets 630*a*, 630*b*, 630*c*, and 630*f* as controlled by control point $P_{602b}$($\Delta_{630a}$, $\Delta_{630b}$, $\Delta_{630c}$, and $\Delta_{630f}$, respectively) by using the following equations:

$$\Delta_{630a}=\delta_{607a}*360/(360-(\theta_{P602b}-\theta_{630a}));$$

$$\delta_{607a}=Z_{630a}-Z_{P602b};$$

$$\Delta_{630b}=\delta_{607b}*360/(360-(\theta_{P602b}-\theta_{630b}));$$

$$\delta_{607b}=Z_{630b}-Z_{P602b};$$

$$\Delta_{630c}=\delta_{607c}*360/(360-(\theta_{P602b}-\theta_{630});$$

$$\delta_{607c}=Z_{630c}-Z_{P602b};$$

$$\Delta_{630f}=\delta_{607f}*360/(360-(\theta_{P602b}-\theta_{630f}));\text{ and}$$

$$\delta_{607f}=Z_{630f}-Z_{P602b}.$$

At step 712, the engineering tool may calculate the critical depth of cut provided by the selected control point ($\Delta_{Pi}$) by determining the maximum value of the depths of cut of the cutlets $C_j$ as controlled by the selected control point $P_i$ ($\Delta_{Cj}$) and calculated in step 710. This determination may be expressed by the following equation:

$$\Delta_{Pi}=\max\{\Delta_{Cj}\}.$$

For example, control point $P_{602b}$ may be selected in step 710 and the depths of cut for cutlets 630*a*, 630*b*, 630*c*, and 630*f* as controlled by control point $P_{602b}$($\Delta_{630a}$, $\Delta_{630b}$, $\Delta_{630c}$, and $\Delta_{630f}$, respectively) may also be determined in step 710, as shown above. Accordingly, the critical depth of cut provided by control point $P_{602b}$($\Delta_{P602b}$) may be calculated at step 712 using the following equation:

$$\Delta_{P602b}=\max[\Delta_{630a},\Delta_{630b},\Delta_{630c},\Delta_{630f}].$$

The engineering tool may repeat steps 710 and 712 for all of the control points $P_i$ identified in step 706 to determine the critical depth of cut provided by all control points $P_i$ located at radial coordinate $R_f$. For example, the engineering tool may perform steps 710 and 712 with respect to control points $P_{602d}$ and $P_{602f}$ to determine the critical depth of cut provided by control points $P_{602d}$ and $P_{602f}$ with respect to cutlets 630*a*, 630*b*, 630*c*, and 630*f* at radial coordinate $R_F$ shown in FIGS. 6A and 6B (e.g., $\Delta_{P602d}$ and $\Delta_{P602f}$, respectively).

At step 714, the engineering tool may calculate an overall critical depth of cut at the radial coordinate $R_f$ ($\Delta_{Rf}$) selected in step 706. The engineering tool may calculate the overall critical depth of cut at the selected radial coordinate $R_f$ ($\Delta_{Rf}$) by determining a minimum value of the critical depths of cut of control points $P_i$ ($\Delta P_i$) determined in steps 710 and 712. This determination may be expressed by the following equation:

$$\Delta_{Rf}=\min\{\Delta_{Pi}\}.$$

For example, the engineering tool may determine the overall critical depth of cut at radial coordinate $R_F$ of FIGS. 6A and 6B by using the following equation:

$$\Delta_{RF}=\min[\Delta_{P602b},\Delta_{P602d},\Delta_{P602f}].$$

The engineering tool may repeat steps 706 through 714 to determine the overall critical depth of cut at all the radial coordinates $R_f$ generated at step 704.

At step 716, the engineering tool may plot the overall critical depth of cut ($\Delta_{Rf}$) for each radial coordinate $R_f$, as a function of each radial coordinate $R_f$. Accordingly, a critical depth of cut control curve may be calculated and plotted for the radial swath associated with the radial coordinates $R_f$. For example, the engineering tool may plot the overall critical depth of cut for each radial coordinate $R_f$ located within radial swath 608, such that the critical depth of cut control curve for swath 608 may be determined and plotted, as depicted in FIGS. 6C and 6D. Following step 716, method 700 may end. Accordingly, method 700 may be used to calculate and plot a critical depth of cut control curve of a drill bit. The critical depth of cut control curve may be used to determine whether the drill bit provides a substantially even control of the depth of cut of the drill bit. Therefore, the critical depth of cut control curve may be used to modify the DOCCs and/or blades of the drill bit configured to control the depth of cut of the drill bit.

Modifications, additions, or omissions may be made to method 700 without departing from the scope of the present disclosure. For example, the order of the steps may be performed in a different manner than that described and some steps may be performed at the same time. Additionally, each individual step may include additional steps without departing from the scope of the present disclosure.

Figure 8:
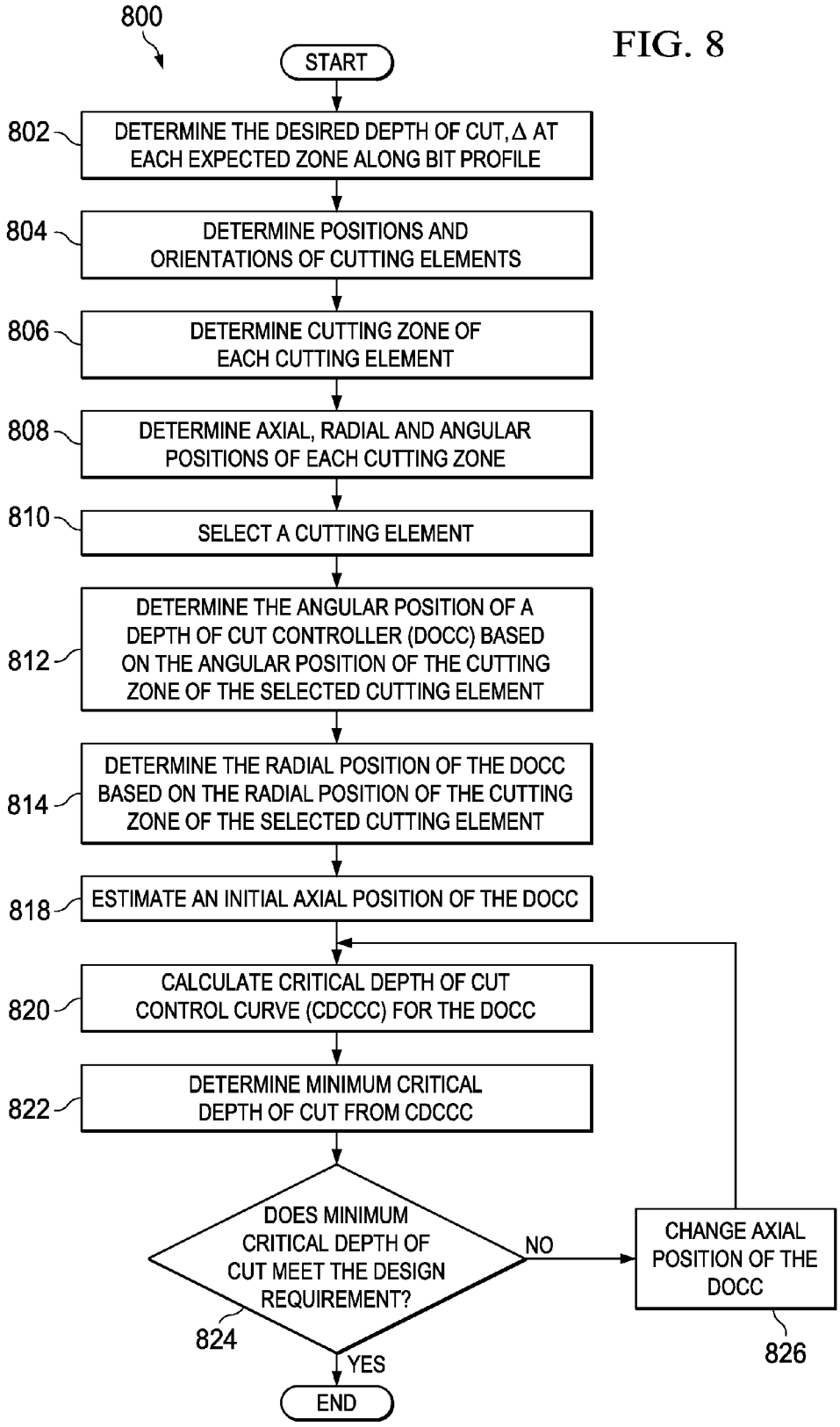
FIG. 8 illustrates an example method of configuring a DOCC, in accordance with some embodiments of the present disclosure.

FIG. 8 illustrates an example method of configuring a DOCC, in accordance with an embodiment of the present disclosure. Similar to method 700, one or more steps of method 800 may be performed by any suitable engineering tool. In the illustrated embodiment, the cutting structures of a drill bit including at least the locations and orientations of all cutting elements may have been previously designed. However in other embodiments, method 800 may include steps for designing the cutting structure of the drill bit. In the illustrated embodiment, the cutting structures of the drill bit, including at least the locations and orientations of all cutting elements, may have been previously designed. However in other embodiments, method 800 may include steps for designing the cutting structure of the drill bit. For illustrative purposes, method 800 is described with respect to drill bit 601 of FIGS. 6A-6D; however, method 800 may be used to configure DOCCs of any suitable drill bit.

Method 800 may start and, at step 802, the engineering tool may determine a desired depth of cut ("Δ") at a selected zone along a bit profile. In the illustrated embodiment, the selected zone may be radial swath 608 defined between $R_A$ and $R_B$. The desired depth of cut Δ may be based on a desired ROP for a given RPM, such that DOCCs 602 within radial swath 608 may be designed to be in contact with the formation at the desired ROP and RPM, and, thus, control the depth of cut of cutting elements in radial swath 608 at the desired ROP and RPM. In the illustrated embodiment, the desired depth of cut may be 0.3 in/rev.

At step 804, the locations and orientations of cutting elements 628/629 within radial swath 608 may be determined. At step 806, the engineering tool may create a 3D cutter/rock interaction model that may determine the cutting zone for each cutting element 628/629 in the radial swath 608 based at least in part on the expected depth of cut Δ for each cutting element 628/629. As noted above, the positions of the cutting zone and cutting edge of each cutting element 628/629 may be based on the axial and radial coordinates of the cutting element 628/629.

At step 808, the engineering tool may determine the axial, radial, and angular positions of each cutting zone of each cutting element 628/629 at least partially located in radial swath 608. For example, the engineering tool may determine the axial, radial, and angular positions of the respective cutting zones of cutting elements 628*a*, 628*b*, 628*c*, 629*c*, 628*d*, 629*d*, 628*e*, 629*e*, 628*f*, and 629*f*.

At step 810, the engineering tool may select a cutting element 628/629 located within radial swath 608. The engineering tool may select the cutting element 628/629 based on input received from a user of the engineering tool. At step 812, the engineering tool may determine an angular position for placement of a DOCC 602 based on the angular position of the cutting element 628/629 selected at step 810.

For example, the engineering tool may select cutting element 628*b* at step 810, and at step 812, the engineering tool may select an angular position for placing DOCC 602*b* on blade 626*b* such that DOCC 602*b* is placed behind (with respect to the rotation of drill bit 601) cutting element 628*b*. In an alternative embodiment, the engineering tool may select cutting element 628*b* at step 810, and at step 812, the engineering tool may select an angular position for placing DOCC 602*b* on blade 626*c* such that DOCC 602*b* is placed in front of (with respect to the rotation of drill bit 601) cutting element 628*b*. In other embodiments, the engineering tool may select cutting element 628*b* at step 810, and at step 812, the engineering tool may select an angular position for placing DOCC 602*b* on blade 626*d*, or on blade 626*e* or on blade 626*f*.

At step 814, the engineering tool may determine the radial position of the DOCC 602 of step 812 based on the radial position of the cutting zone of the cutting element 628/629 selected at step 810. For example, the engineering tool may determine the radial position of DOCC 602*b* based on the radial position of the cutting zone of cutting element 628*b*. Additionally, the engineering tool may determine an adequate size for DOCC 602*b* such that DOCC 602*b* substantially overlaps the radial width of the cutting zone of cutting element 628*b*.

At step 818, the engineering tool may estimate an initial axial position of the DOCC 602 of steps 812 and 814. The engineering tool may estimate the initial axial position of the DOCC based on the desired depth of cut received at step 802. For example, the engineering tool may estimate an initial axial position of DOCC 602*b* based on the desired depth of cut of 0.3 in/rev.

At step 820, the engineering tool may use method 700 to calculate a CDCCC for the DOCC 602 of steps 812, 814, and 818. For example, the engineering tool may use method 700 to calculate a CDCCC for a radial swath that is defined by at least the inner and outer edges of DOCC 602*b* to calculate a CDCCC for DOCC 602*b*.

At step 822, the engineering tool may determine the minimum critical depth of cut as provided by the DOCC 602 based on the CDCCC. For example, the engineering tool may generate a CDCCC for DOCC 602*b* and the lowest point on the CDCCC associated with DOCC 602*b* may correspond with the minimum critical depth of cut as provided by DOCC 602*b*, as described above with respect to FIGS. 6C and 6D At step 824, the engineering tool may determine whether the minimum critical depth of cut as provided by the DOCC 602 meets the design requirements. For example, in the illustrated embodiment, the engineering tool may determine whether the minimum critical depth of cut as provided by DOCC 602*b* is substantially equal to the desired depth of cut of 0.3 in/rev.

If the minimum critical depth of cut as provided by the DOCC 602 at step 824 does not meet the design requirements, method 800 may proceed to step 826. At step 826, the engineering tool may change the axial position of the DOCC 602 and method 800 may return to step 820 to recalculate the CDCCC based on the changed axial position of the DOCC 602.

If the minimum critical depth of cut as provided by the DOCC 602 at step 824 does meet the design requirements, method 800 may end. Steps 810 through 826 may be repeated for configuring any number of DOCCs 602. For example, steps 810 through 826 may be repeated to configure DOCCs 602*d* and 602*f* of drill bit 601.

Accordingly, method 800 may be used to configure one or more DOCCs 602 based on the cutting zones of cutting elements 628/629 and by using a CDCCC. By configuring DOCCs 602 using method 800 the depth of cut control as provided by DOCCs 602 may be improved.

Modifications, additions, or omissions may be made to method 800 without departing from the scope of the present disclosure. For example, although method 800 describes calculating a CDCCC for an individual DOCC 602, a CDCCC may be calculated such that the minimum critical depth of cut as provided by each of a plurality of DOCCs 602 may be adjusted (similar to shown above with respect to FIGS. 6C and 6D). Accordingly, the axial positions of each of a plurality of DOCCs 602 may be adjusted at the same time, as described above with respect to FIGS. 6C and 6D. Additionally, method 800 may be used to determine the radial, axial, and angular positions of backup cutting elements.

As shown by FIGS. 6A and 6B, a drill bit may include more than one DOCC that may be configured to control the depth of cut of the drill bit within the same radial swath of the drill bit. Multiple DOCCs may also be configured to control the depth of cut of the drill bit within the same radial swath determined by a cutting zone of a cutting element. For example, the engineering tool may select cutting element 628*b* at step 810, and at step 812, the engineering tool may determine the angular and radial positions for placing up to 6 DOCCs on blades 626*a*, 626*b*, 626*c*, 626*d*, 626*e*, 626*f*, respectively based on the angular and radial positions of the cutting zone of cutting element 628*b*. Multiple DOCCs may also be used to reduce imbalance forces when DOCCs are in contact with a formation.

Figure 9A:
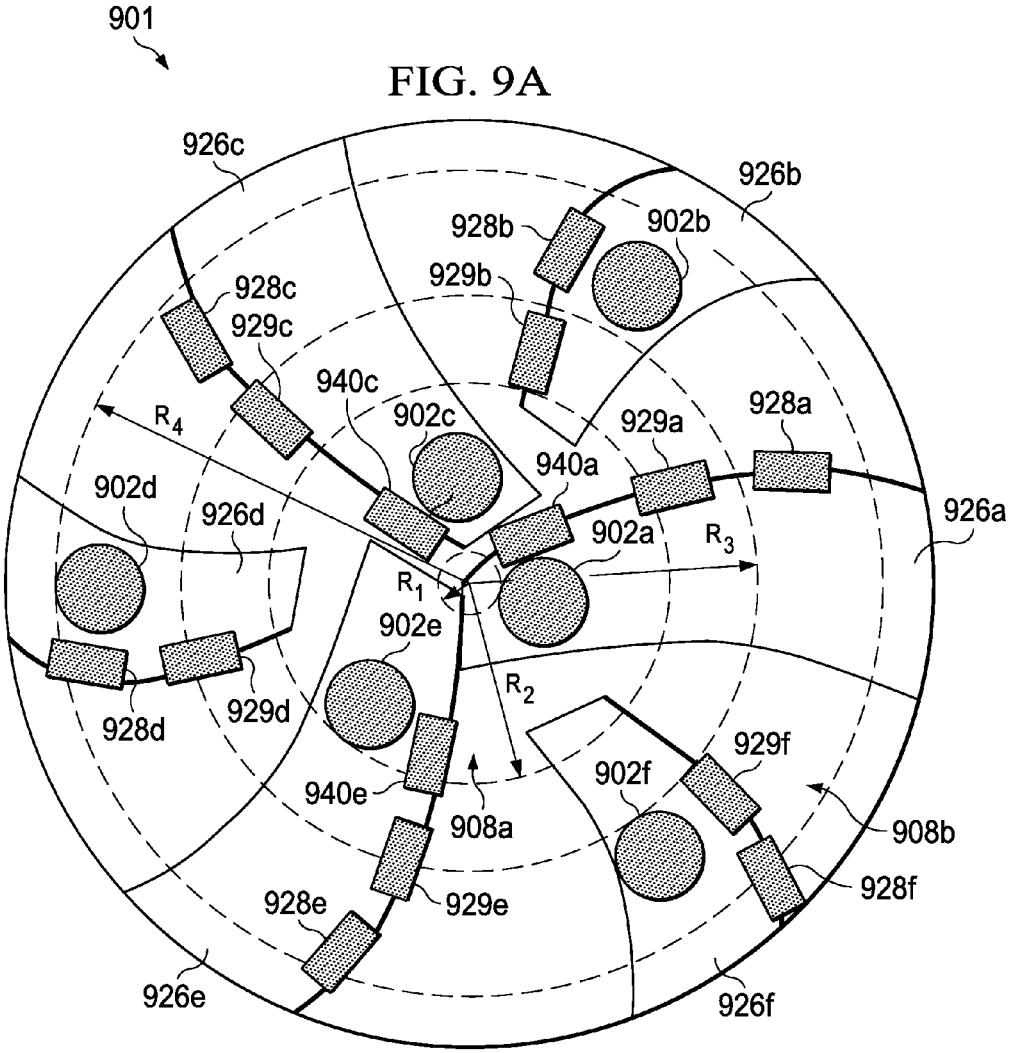
FIG. 9A illustrates an example of a drill bit that includes a plurality of DOCCs configured to control the depth of cut of a drill bit, in accordance with some embodiments of the present disclosure.
Figure 9B:
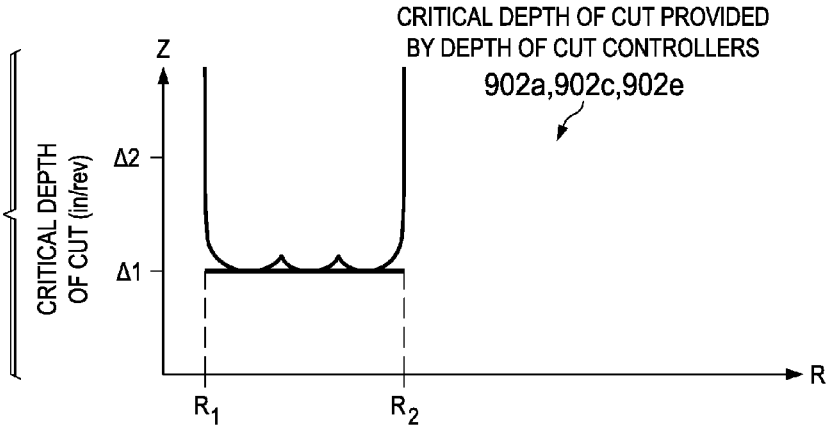
FIGS. 9B-9D illustrate critical depth of cut control curves of the drill bit of FIG. 9A, in accordance with some embodiments of the present disclosure.

FIG. 9A illustrates the bit face of a drill bit 901 that includes DOCCs 902*a*, 902*b*, 902*c*, 902*d*, 902*e* and 902*f* configured to control the depth of cut of cutting elements 928, 929 and/or 940 disposed on blades 926 of drill bit 901. In the illustrated embodiment, DOCCs 902*a*, 902*c* and 902*e* may be configured such that drill bit 901 has a critical depth of cut of $\Delta_1$ within a radial swath 908*a* defined as being located between a first radial coordinate $R_1$ and a second radial coordinate $R_2$, as shown in FIGS. 9A and 9B.

Figure 9C:
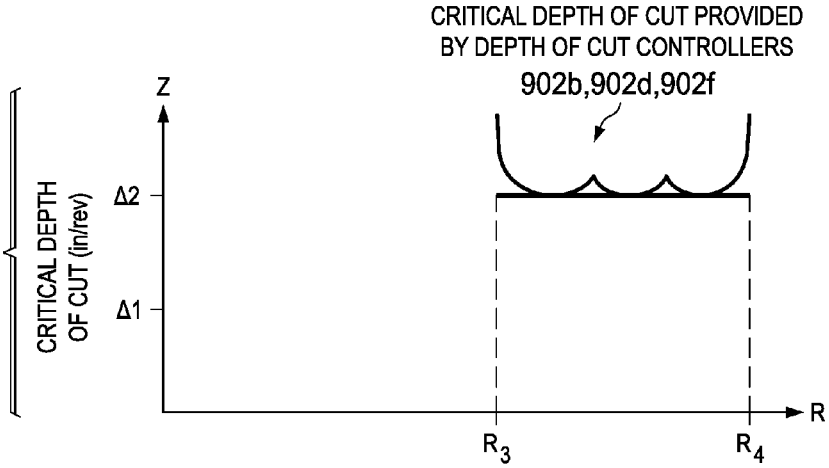
Figure 9D:
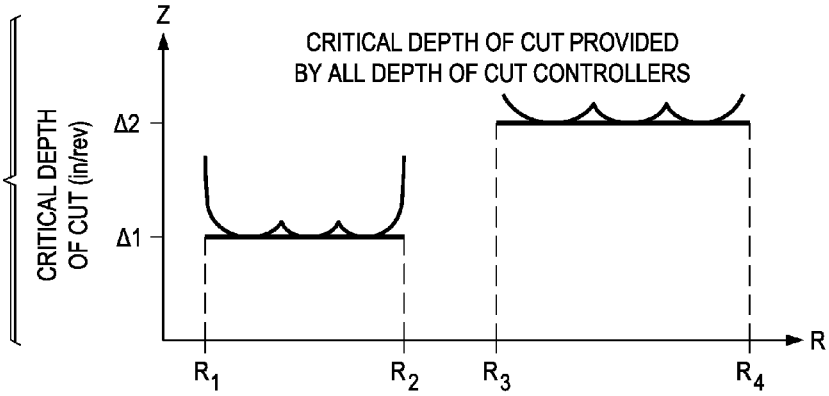

Additionally, DOCCs 902*b*, 902*d* and 902*f* may be configured such that drill bit 901 has a critical depth of cut of $\Delta_2$ within a radial swath 908*b* defined as being located between a third radial coordinate $R_3$ and a fourth radial coordinate $R_4$ as shown in FIGS. 9A and 9C. Accordingly, DOCCs 902 may be configured such that drill bit 901 has a first critical depth of cut $\Delta_1$ for radial swath 908*a* and a second critical depth of cut $\Delta_2$ for radial swath 908*b*, as illustrated in FIGS. 9A and 9D. Each DOCC 902 may be configured using methods 700 and 800, described above. Additionally, DOCCs 902 may be disposed on blades 926 such that lateral forces created by DOCCs 902 may substantially be balanced as drill bit 901 drills at or over critical depth of cuts $\Delta_1$ and/or $\Delta_2$. For example, in the illustrated embodiment, DOCC 902*a* may be disposed on a blade 926*a*, DOCC 902*c* may be disposed on a blade 926*c* and DOCC 902*e* may be disposed on a blade 926*e*. DOCCs 902*a*, 902*c*, and 902*e* may be placed on the respective blades 926 such that DOCCs 902*a*, 902*c*, and 902*e* are spaced approximately 120 degrees apart to more evenly balance the lateral forces created by DOCCs 902*a*, 902*c*, and 902*e* as drill bit 901 drills at or over critical depth of cut $\Delta_1$. DOCCs 902*b*, 902*d*, and 902*f* may be similarly configured and balanced. Therefore, DOCCs 902 may be configured to provide an improved depth of cut control for drill bit 901 at radial swaths 908*a* and 908*b* and may improve the force balance conditions of drill bit 901.

As such, drill bit 901 may include DOCCs 902 configured according to methods 700 and 800 to improve the depth of cut control of DOCCs 902. Therefore, as illustrated by critical depth of cut control curves illustrated in FIGS. 9B-9D, DOCCs 902*a*, 902*c* and 902*e* may be configured to provide substantially the same minimum critical depth of cut control for drill bit 901 at radial swath 908*a* based on a first desired critical depth of cut for radial swath 908*a*. Further DOCCs 902*b*, 902*d* and 902*f* may be configured to provide substantially the same minimum critical depth of cut control for drill bit 901 at radial swath 908*b* based on a second desired critical depth of cut for radial swath 908*b*. Also, DOCCs 902 may be located on blades 926 to improve the force balance conditions of drill bit 901.

Modifications, additions or omissions may be made to FIGS. 9A-9D without departing from the scope of the present disclosure. For example, although DOCCs 902 are depicted as being substantially round, DOCCs 902 may be configured to have any suitable shape depending on the design constraints and considerations of DOCCs 902. Additionally, although drill bit 902 includes a specific number of DOCCs 902, drill bit 902 may include more or fewer DOCCs 902.

Although the present disclosure has been described with several embodiments, various changes and modifications may be suggested to one skilled in the art. For example, although the present disclosure describes the configurations of blades and DOCCs with respect to drill bits, the same principles may be used to control the depth of cut of any suitable drilling tool according to the present disclosure. It is intended that the present disclosure encompasses such changes and modifications as fall within the scope of the appended claims.

What is claimed is:

1. A method of configuring a depth of cut controller (DOCC) of a drill bit comprising:

determining a first desired minimum depth of cut for a first radial swath associated with a bit face of the drill bit, the first radial swath associated with a first area of the bit face;

identifying a first cutting edge of a first cutting element located on the bit face, the first cutting edge located within a first cutting zone of the first cutting element and located within the first radial swath;

identifying a first plurality of cutting elements located on the bit face that each include at least a portion located within the first radial swath; and determining a first radial position and a first angular position of a first depth of cut controller (DOCC) for placement on the bit face within the first radial swath based on the first cutting edge of the first cutting element; and determining a first axial position of the first DOCC based on the first desired minimum depth of cut for the first radial swath and each portion of the first plurality of cutting elements located within the first radial swath.

2. The method of claim 1, further comprising:

determining a second desired minimum depth of cut for a second radial swath associated with a bit face of the drill bit, the second radial swath associated with a second area of the bit face;

identifying a second cutting edge of a second cutting element located on the bit face, the second cutting edge located within a second cutting zone of the second cutting element and located within the second radial swath;

identifying a second plurality of cutting elements located on the bit face that each include at least a portion located within the second radial swath; and determining a second radial position and a second angular position of a second depth of cut controller (DOCC) for placement on the bit face within the second radial swath based on the second cutting edge of the second cutting element; and determining a second axial position of the second DOCC based on the second desired minimum depth of cut for the second radial swath and each portion of the second plurality of cutting elements located within the second radial swath.

3. The method of claim 2, wherein the second radial swath is proximate the first radial swath such that the second radial swath overlaps the first radial swath on the bit face.

4. The method of claim 2, wherein the second radial swath is proximate the first radial swath such that the second radial swath is located adjacent to the first radial swath on the bit face.

5. The method of claim 2, wherein the second radial swath is proximate the first radial swath such that the second radial swath is separated from the first radial swath on the bit face.

6. The method of claim 2, wherein the second desired minimal depth of cut is equal to the first desired minimal depth of cut.

7. The method of claim 6, further comprising configuring the plurality of DOCCs to balance lateral forces of the drill bit created by the plurality of DOCCs.

8. The method of claim 1, further comprising:

determining a plurality of radial coordinates associated with the first DOCC, each of the plurality of radial coordinates associated with one of a plurality of control points;

determining a plurality of intersection points associated with the first cutting edge, each of the plurality of intersection points having approximately the same radial coordinate as one of the control points;

determining an axial coordinate for each of the plurality of intersection points; and calculating a minimum critical depth of cut for the first DOCC based on the axial coordinates, the radial coordinates and the angular coordinates of the intersection points, and the angular coordinates of the control points.

9. The method of claim 8, further comprising:

adjusting the axial position of the first DOCC; and recalculating the minimum critical depth of cut for the first DOCC until the calculated minimum critical depth of cut for the DOCC is substantially equal to the first desired critical depth of cut.

10. The method of claim 1, wherein the plurality of cutting elements comprises all the cutting elements located on the bit face that each include at least a portion located within the first radial swath.

11. The method of claim 1, wherein each portion of the first plurality of cutting elements includes a cutting edge of its associated cutting element, the cutting edge located within a cutting zone of the cutting element.

12. The method of claim 1, further comprising determining a size of the first DOCC based on the first cutting edge.

13. A drill bit comprising:

a bit body;

a plurality of blades disposed on the bit body to create a bit face;

a rotational axis about which the bit body rotates;

a first plurality of cutting elements each disposed on one of the plurality of blades and including at least a portion located within a first radial swath of the bit face, the first radial swath associated with a first area of the bit face;

a first cutting element of the first plurality of cutting elements having a first cutting edge located within a first cutting zone of the first cutting element and located within the first radial swath; and a first depth of cut controller (DOCC) disposed on one of the plurality of blades, a first radial position and a first angular position of the first DOCC based on the first cutting zone of the first cutting element, and a first axial position of the first DOCC based on each portion of the first plurality of cutting elements located within the first radial swath and configured to control a first minimum depth of cut associated with the first plurality of cutting elements based on a first desired minimum depth of cut for the first radial swath.

14. The drill bit of claim 13, further comprising:

a second plurality of cutting elements each disposed on one of the plurality of blades and including at least a portion located within a second radial swath of the bit face, the second radial swath associated with a second area of the bit face;

a second cutting element of the second plurality of cutting elements having a second cutting edge located within a second cutting zone of the second cutting element and located within the second radial swath; and a second depth of cut controller (DOCC) disposed on one of the plurality of blades, a second radial position and a second angular position of the second DOCC based on the second cutting zone of the second cutting element, and a second axial position of the second DOCC based on each portion of the second plurality of cutting elements located within the second radial swath and configured to control a second minimum depth of cut associated with the second plurality of cutting elements based on a second desired minimum depth of cut for the second radial swath.

15. The drill bit of claim 14, further comprising at least two DOCCs each disposed on one of the plurality of blades and configured to control the first minimum depth of cut at the first radial swath for the first plurality of cutting elements.

16. The drill bit of claim 15, wherein the at least two DOCCs are further configured to be disposed on the blades to balance lateral forces of the drill bit associated with the plurality of DOCCs.

17. The drill bit of claim 13, wherein the first DOCC is an impact arrestor.

18. The drill bit of claim 13, wherein the first DOCC is a Modified Diamond Reinforcement (MDR).

19. The drill bit of claim 13, wherein the plurality of cutting elements comprises all the cutting elements located on the bit face that each includes at least a portion located within the first radial swath.

20. The drill bit of claim 13, wherein each portion of the plurality of cutting elements includes a cutting edge of its associated cutting element, the cutting edge located within a cutting zone of the cutting element.

21. A method of configuring a depth of cut controller (DOCC) of a drill bit comprising:

determining a desired minimum depth of cut for a radial swath associated with a bit face of the drill bit, the radial swath associated with an area of the bit face;

identifying a cutting edge of a cutting element located on the bit face, the cutting edge located within a cutting zone of the cutting element and located within the radial swath;

identifying all cutting elements located on the bit face that each include at least a portion located within the first radial swath; and determining a radial position and angular position of a depth of cut controller (DOCC) for placement on the bit face within the radial swath based on the cutting edge of the cutting element; and determining an axial position of the DOCC based on the desired minimum depth of cut for the radial swath and each portion of all the cutting elements located within the radial swath.

* * * * *